US005937550A

United States Patent [19]

Emrich

[11] Patent Number: 5,937,550

[45] Date of Patent: Aug. 17, 1999

[54] EXTENSIBLE LOCK

[75] Inventor: Robert K. Emrich, Tigard, Oreg.

[73] Assignee: Esco Corporation, Portland, Oreg.

[21] Appl. No.: 08/927,013

[22] Filed: Sep. 10, 1997

Related U.S. Application Data

[63] Continuation-in-part of application No. 08/570,438, Dec. 11, 1995, Pat. No. 5,709,043, and a continuation-in-part of application No. PCT/US96/19726, Dec. 11, 1996.

[51] Int. Cl.[6] ..... E02F 9/28

[52] U.S. Cl. ..... 37/458; 37/456

[58] Field of Search ..... 37/955, 456, 457, 37/458, 459; 403/153, 154

[56] References Cited

U.S. PATENT DOCUMENTS

| | | | |
|---|---|---|---|
| D. 352,044 | 11/1994 | Hahn . | |
| 2,435,846 | 2/1948 | Robertson . | |
| 2,689,419 | 9/1954 | Daniels et al. . | |
| 2,852,874 | 9/1958 | Grubb . | |
| 2,861,362 | 11/1958 | Liard et al. . | |
| 2,885,801 | 5/1959 | Hill . | |
| 3,023,521 | 3/1962 | Brunner, Jr. . | |
| 3,117,386 | 1/1964 | Ferwerda . | |
| 3,196,956 | 7/1965 | Ratkowski . | |
| 3,774,324 | 11/1973 | Lafond . | |
| 3,831,298 | 8/1974 | Helton et al. | 37/457 |
| 3,851,413 | 12/1974 | Lukavich . | |
| 4,067,657 | 1/1978 | Kaarlela | 37/456 X |
| 4,231,173 | 11/1980 | Davis . | |
| 4,233,761 | 11/1980 | Ryerson . | |
| 4,335,532 | 6/1982 | Hahn et al. . | |
| 4,338,736 | 7/1982 | Radigan . | |
| 4,404,760 | 9/1983 | Hahn et al. . | |
| 4,433,496 | 2/1984 | Jones et al. . | |
| 4,481,728 | 11/1984 | Mulder et al. . | |
| 4,611,418 | 9/1986 | Launder . | |
| 4,751,785 | 6/1988 | Johansson et al. . | |
| 4,903,420 | 2/1990 | Kreitzberg et al. . | |
| 4,932,478 | 6/1990 | Jones . | |
| 4,965,945 | 10/1990 | Emrich . | |
| 5,009,017 | 4/1991 | Diekevers et al. . | |
| 5,088,214 | 2/1992 | Jones . | |
| 5,241,765 | 9/1993 | Jones et al. . | |
| 5,272,824 | 12/1993 | Cornelius . | |
| 5,337,495 | 8/1994 | Pippins . | |
| 5,386,653 | 2/1995 | Cornelius . | |
| 5,410,826 | 5/1995 | Immel et al. | 37/457 |
| 5,423,138 | 6/1995 | Livesay et al. . | |
| 5,456,029 | 10/1995 | Cornelius . | |
| 5,469,648 | 11/1995 | Jones et al. . | |
| 5,491,915 | 2/1996 | Robinson | 37/457 X |
| 5,653,048 | 8/1997 | Jones et al. . | |
| 5,784,813 | 7/1998 | Balassa et al. | 37/457 X |

OTHER PUBLICATIONS

Advertisement for "New Tuf–Tip™ Teeth!", Page Engineeering Company. (No Date).

*Primary Examiner*—Thomas B. Will
*Assistant Examiner*—Robert Pezzuto
*Attorney, Agent, or Firm*—Banner & Witcoff, Ltd.

[57] ABSTRACT

An extensible lock for securing a wear member to a support structure of an excavator. The lock includes a base and a body which are extensible and retractable to hold and release the wear member, respectively. The body includes an inclined bearing face which engages a complimentary bearing face on the wear member to pull the wear member onto the support structure and prevent its inadvertent release.

48 Claims, 17 Drawing Sheets

EXTENSIBLE LOCK

This application is a continuation-in-part of U.S. patent application Ser. No. 08/570,438, filed Dec. 11, 1995, now U.S. Pat. No. 5,709,043, and a continuation-in-part of Internal Application Ser. No. PCT/US96/19726, filed Dec. 11, 1996.

FIELD OF THE INVENTION

The present invention pertains to a lock for releasably securing a wear member to a supporting structure of an excavator, and especially to a nose of an adapter.

BACKGROUND OF THE INVENTION

Excavating teeth have long been mounted along the digging edge of buckets and other excavating equipment to break up the ground and enhance the digging operation. The teeth are ordinarily formed of a plurality of parts to reduce the size of the outer wear member needing frequent replacement. In general, an excavating tooth comprises an adapter, a point, and a lock typically in the form of a pin to secure the point to the adapter. The adapter has a rear end which is secured to the digging edge of an excavator and a forwardly projecting nose for mounting the point. The point is a tapered wedge-shaped member provided with a forward digging edge and a rearwardly opening socket adapted to be received over the adapter nose.

Excavating teeth are commonly subjected to heavy loading by large forces applied in a wide variety of directions. As a result, the points must be firmly secured to the adapter to withstand the applied forces, but yet be easily removed and installed for effective replacement of the worn points in the field. Further, wearing of the tooth components causes looseness in the connection which in certain circumstances can result in the pin, and hence, the point being lost. In an effort to increase the life of the assembly, the pin is usually set very tightly in the defined opening. Consequently, the pin must be forcibly driven into and out of the opening. The pin is typically inserted by repeated blows with a heavy sledge hammer. As can be appreciated, this is an onerous and time-consuming task, especially in the larger sized teeth.

SUMMARY OF THE INVENTION

The present invention pertains to a lock which secures a wear member to a support structure of an excavator, and is particularly suited for securing a wear member to a nose of an adapter. The lock includes a base and a body which are coupled together for relative axial movement between locked and release positions. Due to the extensible nature of the lock, the lock remains within a hole in the support structure during replacement of the wear member. As a result, the lock permits easy installation and removal of the wear member, and obviates the need to forcibly drive the lock into or out of position with repeated blows of a sledge hammer. The extension of the lock also enables the user to draw the wear member onto the support structure during installation, and in certain cases, during use as wear develops.

DETAILED DESCRIPTION OF THE PREFERRED EMBODIMENTS

The present invention pertains to a lock for releasably securing a wear member to a support structure of an excavator. While the lock is particularly suited for securing a point to a nose of an adapter in an excavating tooth secured to the digging edge of an excavator, the locks are also usable for securing other wear members (e.g., shrouds) to adapters or other supporting bases. As can be appreciated, the operation of such equipment will cause the wear members to assume many different orientations. Nevertheless, for purposes of explanation, the elements of the disclosed teeth are at times described in regard to relative directions such as up and down. These directions should be understood with respect to the orientation of the tooth as shown in FIG. 1, unless stated otherwise.

An excavating tooth usable with a lock in accordance with the present invention includes a point and an adapter. The adapter includes a rear mounting or base end attached to an excavator (e.g., the digging edge of a bucket), and a forwardly projecting nose. The point has a generally tapered shape which forms a front digging edge and a rearwardly opening socket for receiving the nose. The lock is placed within a transverse hole in the adapter nose to releasably secure the point to the adapter. An extensible lock in accordance with the present invention can be used with adapters and wear members which have wide variations in their construction. For illustration purposes, a few preferred examples of wear members are discussed below. However, the lock of the present invention is not limited only to use in the exemplary teeth.

Figure 1:
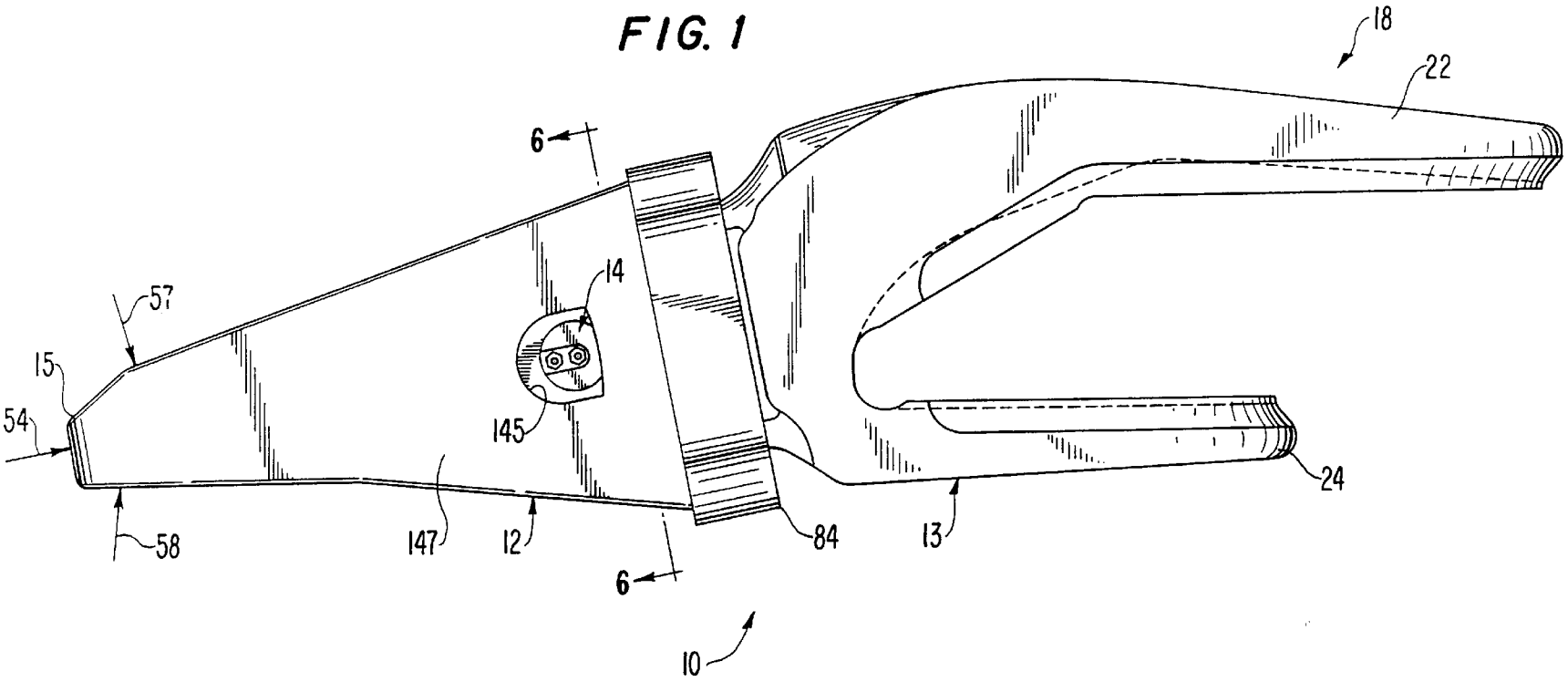
FIG. 1 is a side view of a tooth in accordance with the present invention.
Figure 2:
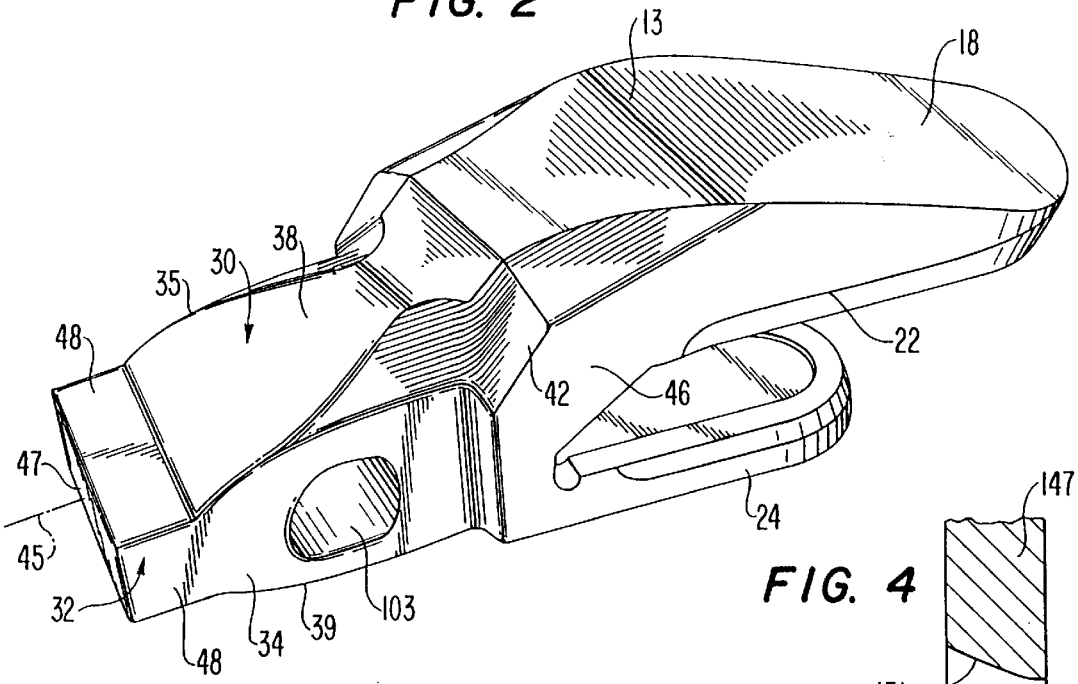
FIG. 2 is a perspective view of an adapter of the tooth.
Figure 63:
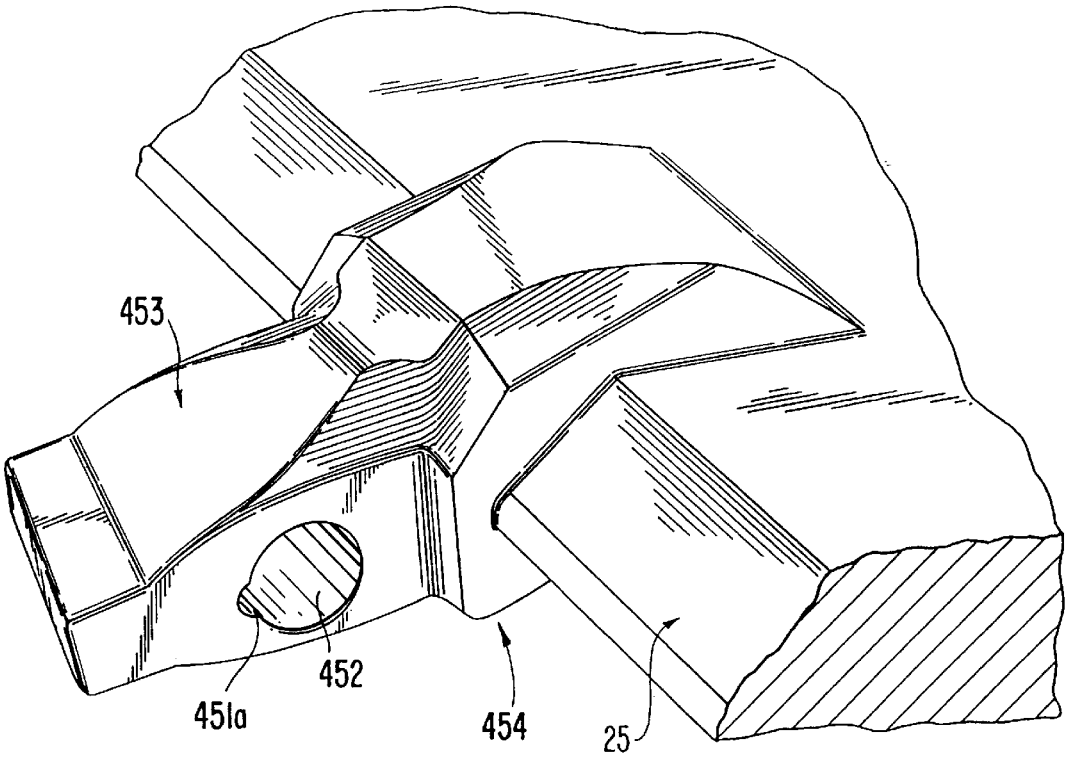
FIG. 63 is a perspective view of an alternative adapter integrally cast with the lip of a bucket which is adapted to receive a lock in accordance with the present invention.

In one example, tooth 10 includes a point 12 and an adapter 13 (FIGS. 1–5). The base end 18 of adapter 13 is provided with a pair of bifurcated legs 22, 24 to straddle the lip of a bucket (FIGS. 1 and 2). With this construction, legs 22, 24 are welded in place along the lip. Nevertheless, the adapter can be secured to the bucket in a number of different ways including, for example, the use of only a single welded leg, a Whisler style connection, or an attachment as disclosed in U.S. Pat. No. 5,653,048 to Jones et al., which is hereby incorporated by reference. Alternatively, the base end of the adapter could be formed as an integrally cast portion of the lip construction 25 (FIG. 63).

Figure 5:
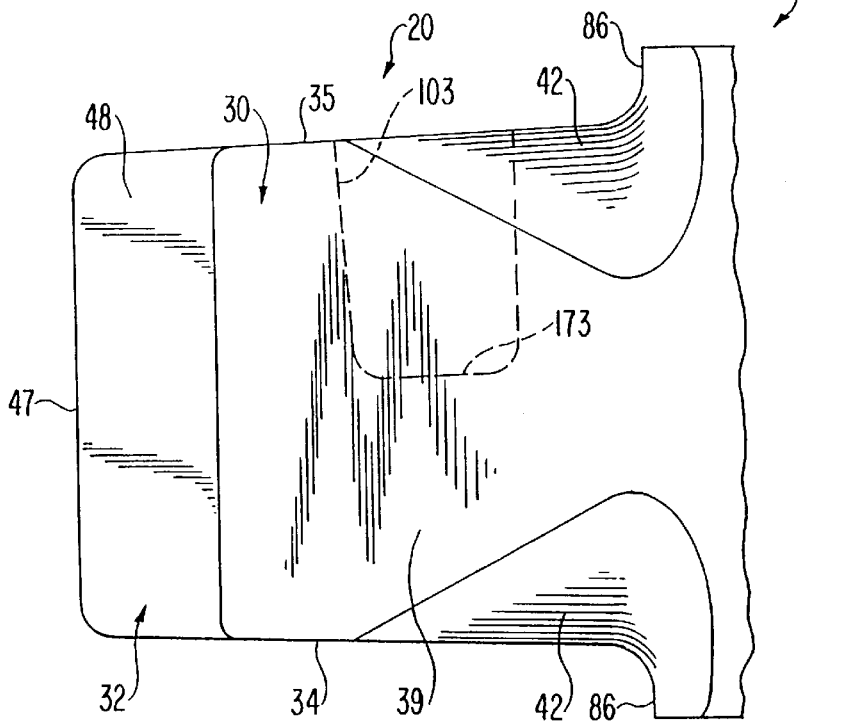
FIG. 5 is a partial bottom plan view of the adapter.

Nose 20 of adapter 13 has a rear body portion 30 which is generally wedge shaped and a box-shaped tip portion 32 (FIGS. 1, 2 and 5). The rear body portion 30 is defined by a pair of side walls 34, 35, top and bottom walls 38, 39, and bearing faces 42. The side walls 34, 35 are generally planar surfaces which are substantially parallel to one another; although a slight taper is usually provided for manufacturing purposes. The top and bottom walls 38, 39 are tapered to define a body portion which has a generally wedge shaped configuration.

Figure 6:
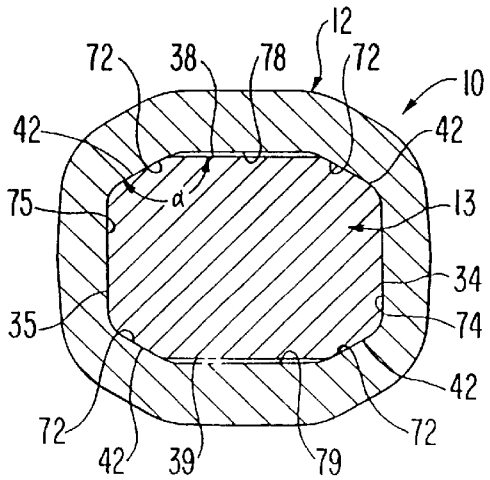
FIG. 6 is a cross-sectional view taken along line 6—6 in FIG. 1.

In the preferred construction, a bearing face 42 is provided at each juncture of the side walls 34, 35 with the top and bottom walls 38, 39 at obtuse angles a thereto (FIGS. 2 and 6). Bearing faces 47–48 are also provided at the tip portion 22 of the nose. Bearing faces 42 and 48 are substantially planar and lie substantially parallel to axis 45 of tooth 10. As can be appreciated, rear bearing faces 42 and tip bearing faces 48 provide a stable framework for supporting point 12 under loading in vertical directions such as indicated by arrows 57, 58. The construction and operation of the bearing faces is discussed more fully in co-pending U.S. patent application Ser. No. 08/570,438, filed Dec. 11, 1995, and entitled "Excavating Tooth," hereby incorporated by reference. Front bearing face 47 extends generally orthogonally between top and bottom bearing faces 48 to resist thrust forces generally in the direction of arrow 54 (FIG. 1). The formation of such bearing areas is preferred to provide a firm and stable resistance to the applied forces so as to avoid overloading the lock.

Figure 3:
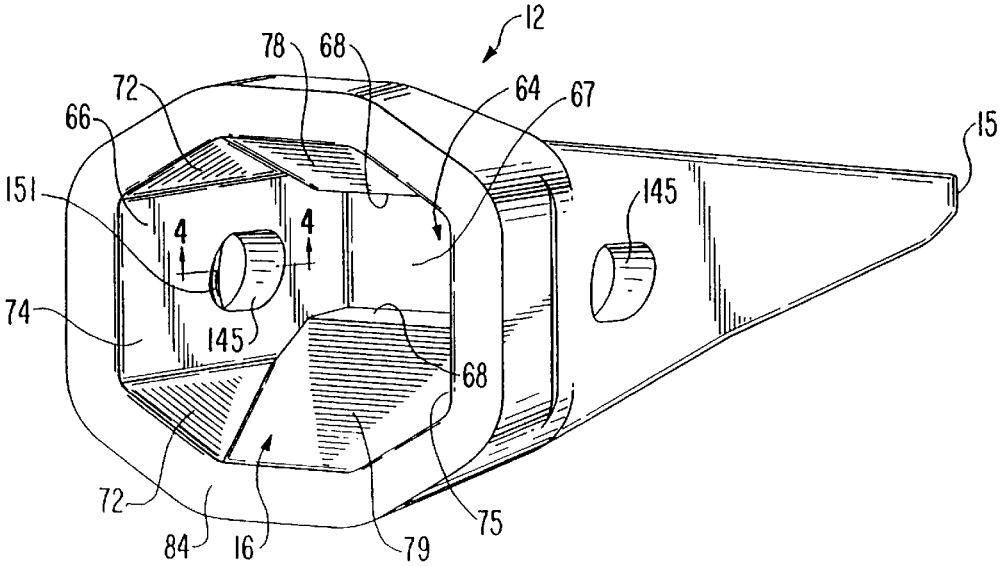
FIG. 3 is a perspective view of a point of the tooth.

As can be appreciated, socket 16 has basically the same configuration as nose 20 (FIG. 3). In particular, socket 16 comprises a box-shaped front portion 64 at its apex and a generally wedge-shaped rear cavity 66. Front portion 64 includes front, top and bottom bearing faces 67, 68 which are adapted to abut bearing faces 47, 48 of nose 20, respectively. Likewise, cavity 66 includes bearing faces 72 which are adapted to abut bearing faces 42. Top and bottom walls 78, 79 of cavity 66 are tapered to extend generally parallel to or slightly divergent (in a rearward direction) from top and bottom walls 38, 39 of nose 20. Walls 78, 79 are, however, spaced from walls 38, 39 to ensure that the bearing engagement occurs along the engagement of bearing faces 42, 72 (FIG. 6). Cavity 66 further includes sidewalls 74, 75 which are generally parallel to sidewalls 34, 35 (FIG. 3), but slightly spaced therefrom.

In one embodiment, point 12 is releasably secured to adapter 13 by lock 14 (FIGS. 7–15). Lock 14 is an extensible lock which includes a base 90 for receiving a body 92, a retracting screw 96, and a spring 94 for biasing the body 92 outward.

Figure 7:
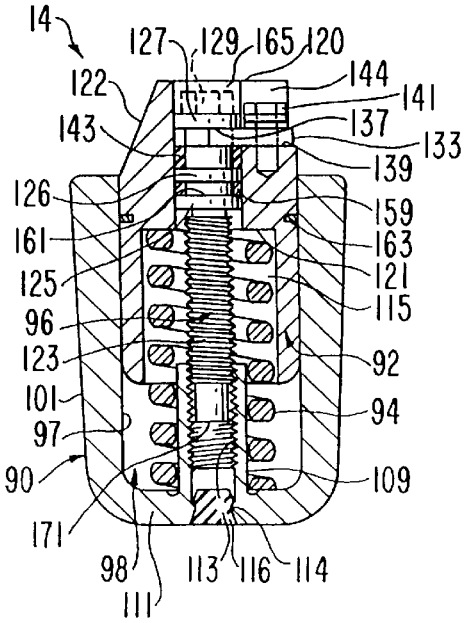
FIG. 7 is a sectional view of an extensible lock in accordance with the present invention.
Figure 8:
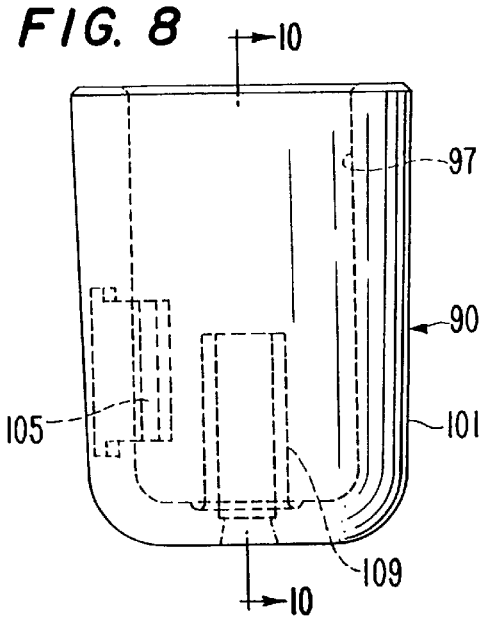
FIG. 8 is a side view of a base for the extensible lock.
Figure 9:
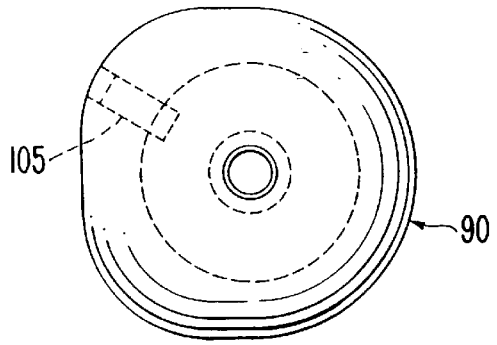
FIG. 9 is a bottom view of the base.
Figure 10:
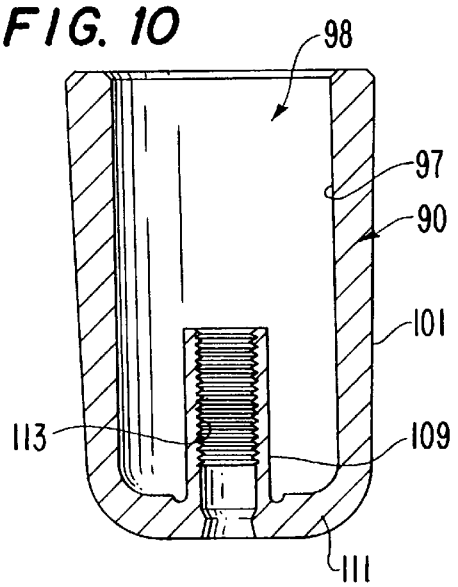
FIG. 10 is a cross sectional view taken along line 10—10 in FIG. 8.
Figure 11:
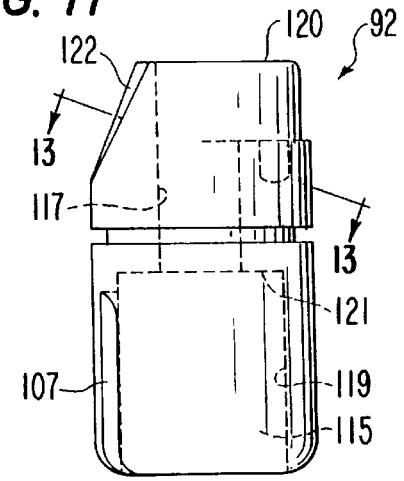
FIG. 11 is a side view of a body for the extensible lock.
Figure 12:
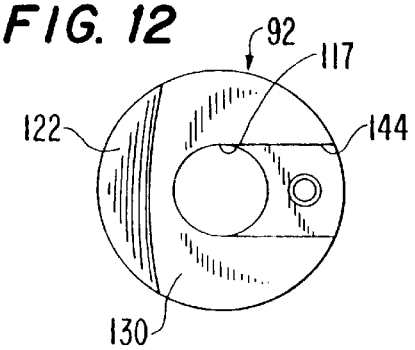
FIG. 12 is a top view of the body.
Figure 13:
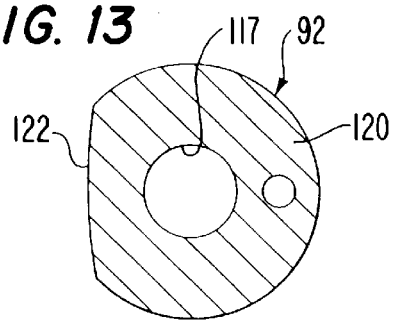
FIG. 13 is a cross sectional view taken along line 13—13 in FIG. 11.

Base 90 is a rigid, hollow member with an inner surface 97 that defines a generally cylindrical cavity 98 which is open on one end to movably receive body 92 (FIGS. 7, 8 and 10). In this embodiment, the base supports the axial motion of the body and provides a clear path for the movement of the body. The outer surface 101 of the base is fit within hole 103 in sidewall 35 of adapter 13 (FIGS. 2 and 5). While outer surface 101 and hole 103 are preferably D-shaped (FIGS. 2 and 9) to ensure positioning of the lock in its proper orientation, other configurations could be used. A key 105 extends along inner wall 97 to cooperate with keyway 107 to prevent rotation of body 92 (FIGS. 8, 9 and 11). Of course, other arrangements, such as non-circular mating surfaces for the body and the base, could also be used to prevent relative rotation between the body and the base. A tubular hub 109 extends upward from the bottom wall 111 of base 90 (FIGS. 7, 8 and 10). Hub 109 includes an internal bore 113 which is threaded over a portion of its length to receive screw 96. Bore 113 extends completely through hub 109 and bottom wall 111 to facilitate removal of the lock from hole 103 as described below. The lower portion of bore 113 includes a rib 114, angled outwardly on the bottom side to receive a snap in place plug 116.

Body 92 is matingly received in cavity 98 for slidable movement into and out of base 90 (FIG. 7). A graduated opening 115 having a narrow segment 117 and a wide segment 119 extends through the body (FIGS. 7 and 11–13). Full assembly of the inventive tooth places the spring 94 in compression between bottom wall 111 and shoulder 121 defined in opening 115 to bias body 92 in an outward direction. Body 92 further includes a head 120 with a broad arcuate bearing face 122 for engaging the point 12. Bearing face 122 is preferably provided with a large radius of curvature to provide secure engagement with the point even as the point shifts up and down on the adapter nose 20. As best seen in FIG. 11, face 122 is inclined to the longitudinal axis at an angle of about 10°–30°, and preferably at an angle of about 22°. As discussed more fully below, the inclined bearing face functions to pull the point onto the adapter nose along with retaining the point on the nose.

Figure 14:
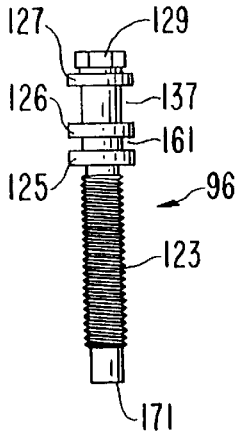
FIG. 14 is a side view of a retracting screw for the extensible lock.
Figure 15:
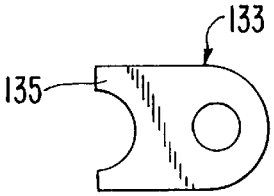
FIG. 15 is a top view of a stop plate for the extensible lock.

Screw 96 includes a threaded shank 123, a series of spaced apart collars 125–127, and a head 129 (FIGS. 7 and 14). Shank 123 extends through opening 115 and is threadedly received in bore 113 of hub 109. A stop plate 133 provided with a claw 135 engages screw 96 in a gap 137 defined between outer collar 127 and middle collar 126 (FIGS. 7 and 14–15). Stop plate 133 is secured to the top face 139 of body 92 by bolt 141 or other attachment means. An elastomeric ring 143 also lies in gap 137 between stop plate 133 and collar 126 (FIG. 7).

To install point 12 on adapter 13, lock 14 is inserted into hole 103. Screw 96, accessible in notch 144 defined in head 120, is rotated so that it moves into hub 109 and, because of the stop plate 133, drives body 92 into base 90 against the bias of spring 94. Rotation of screw 96 continues until head 120 is fully retracted into cavity 98. Point 12 can then be fit onto nose 20 of adapter 130

Figure 4:
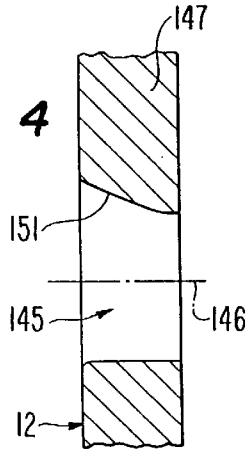
FIG. 4 is a cross sectional view taken along line 4—4 in FIG. 3.

Point 12 includes a hole 145 in at least one of the sidewalls 147 (or alternatively a converging top or bottom wall 38, 39) of the point along a generally transverse axis 146 (FIGS. 3 and 4). A hole can be formed in both sidewalls so the point can be reversed for longer life; although, only one hole need be provided for securing the point to the adapter. Hole 145 further preferably has a generally D-shaped configuration. Hole 145 is provided with a bearing face 151 on its rear side to matingly engage bearing face 122 of lock 14. Face 151 has a broad arcuate shape to better accommodate the rocking movement typically experienced by a point mounted on an adapter during use. Face 151 is inclined such that it converges toward the transverse axis 146 of hole 145 as it extends outward at about the same angle as face 122 (e.g., 10°–30° degrees) so that it continues to be engaged by the face 122 of head 120 irrespective of the amount of wearing. Face 151 may be a single surface that converges toward the transverse axis of the hole as it extends outward, or face 151 may be a two-segmented surface which includes an inner segment that converges toward the transverse axis of the hole as it extends outward, and an outer segment that makes a smooth transition to a substantially parallel alignment to the transverse axis 146 to avoid unduly closing the hole and thereby preventing access to the head of screw 96 (FIG. 4). In either event, the transversely converging portion of face 151 engages the bearing face 122 of the body 92 for pulling and securing the point onto the adapter.

Once point 12 is mounted onto nose 20, screw 96 is rotated to move it out of casing 90 (FIG. 7). Movement of the screw 96 carries body 92 in the same direction until face 122 is firmly engaged against bearing face 151 of hole 145. As screw 96 continues to rotate it moves outward without body 92 such that elastomeric ring 143 is squeezed between middle collar 126 and stop plate 133. Screw 96 is rotated until ring 143 creates firm resistance to any further turning. In this way, the strong force of spring 94 independently pushes on bearing face 151 to hold the point on the adapter. As the parts begin to wear, spring 94 continues to drive body 92 outward so that the engagement of inclined faces 122, 151 pulls point 12 onto the nose of adapter 12. Due to the strength and orientation of the spring and the angle of inclination of the bearing face, overloading of the spring is avoided during use. This outward adjustment of body 92 continues until ring 143 is completely expanded. At that point, abutment of stop plate 133 against collar 127 prevents any further outward movement of the pin body.

Seals are provided throughout the lock to minimize the detrimental effect of soil fines (FIG. 7). A seal 159 is placed in gap 161 defined between collars 125, 126. A seal 163 is further provided around body 92 between its exterior surface and the inner surface 97 of base 90. The cavity 98 is thus sealed to prevent soil fines from becoming lodged within the base and blocking the axial path in which the body moves. The body can be retracted within the base without needing to displace soil fines which may enter hole 103. An elastomeric cap 165 is also preferably fit over head 129 to prevent soil fines from packing into the recess adapted to receive a rotation tool (not shown). Finally, elastomeric plug 116 is compressibly snap fit into the bottom of bore 113.

To remove a worn point from the adapter, screw 96 is simply rotated into hub 109 until head 120 of body 92 is fully retracted into cavity 98. The worn point can then be removed and a new point installed without ever removing the lock from the hole 103 in the adapter nose 20. Nevertheless, if the lock is heavily worn and needing replacement, removal of the lock can be assisted by disengaging the screw 96 from the body 92. This is accomplished by first turning the screw to fully extend the body, thereby removing all spring force acting within the lock assembly.

This permits easy removal of the stop plate 133. After removal of the stop plate, the screw 96 is rotated into the assembly, free of the body 92. This downward movement of the screw will cause its lower end 171 to push plug 116 out of bore 113 so that end 171 presses against the bottom wall 173 of hole 103. Screw 96 will then push base 90 partially out of hole 103 whereby it can be grasped and removed.

Figure 16:
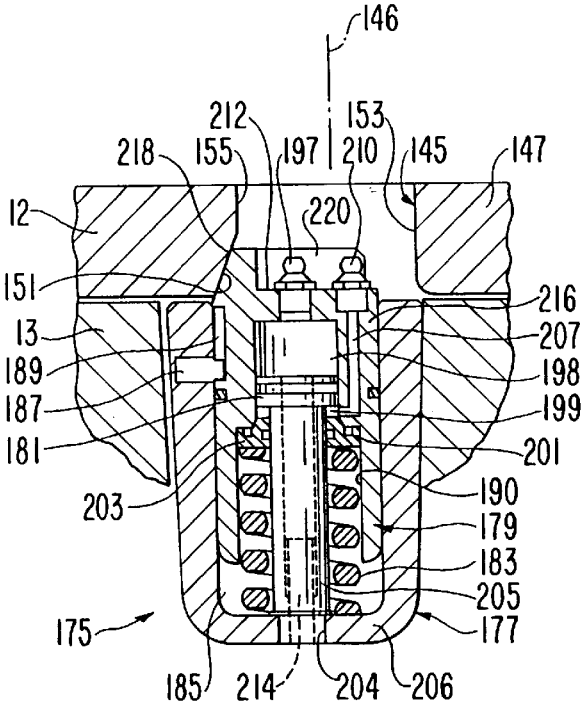
FIG. 16 is a sectional view of a second embodiment of an extensible lock mounted in a tooth assembly.

In an alternative embodiment, lock 175 can be used to secure point 12 to adapter 13 in much the same way as lock 14 (FIGS. 16–20). More specifically, lock 175 includes a generally D-shaped base 177, a body 179, a piston 181, and a spring 183 to bias body 179 out of the base. Lock 175 is adapted to be fit within hole 103 in adapter 13. Base 177 includes a cavity 185 which receives and supports body 179 for axial movement and provides a path for the body which is clear of soil fines. A stop 187 projects inward from base 177 and is received in a slot 189 defined in the exterior of body 179 (FIG. 16). Stop 187 functions to set the outward and inward limits of travel for pin body 179 and to axially align the body with the base.

Figure 17:
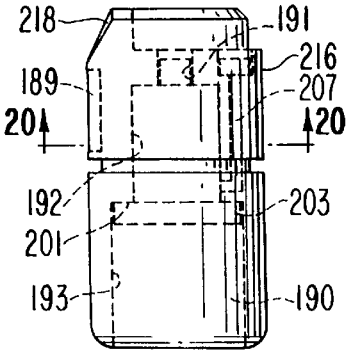
FIG. 17 is a side view of a body for the second embodiment.
Figure 18:
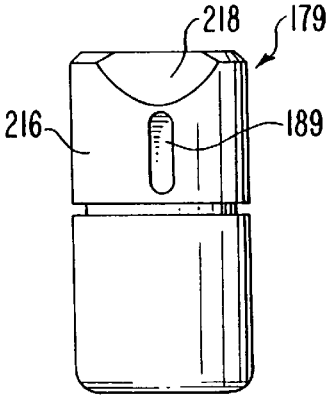
FIG. 18 is a rear view of the body for the second embodiment.
Figure 19:
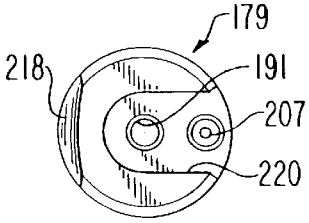
FIG. 19 is a top view of the body for the second embodiment.
Figure 20:
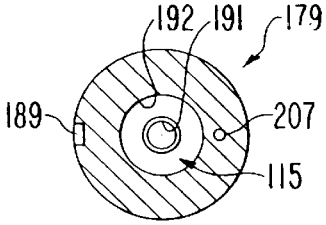
FIG. 20 is a cross-sectional view taken along line 20—20 in FIG. 17.

Body 179 is selectively moved into and out of cavity 185 to engage and release point 12. Cavity 185 is sealed to prevent the ingress of soil fines which could prevent the retraction of the body. Body 179 defines an opening 190 extending therethrough in three graduated segments 191–193 (FIGS. 16–17). The first segment 191 defines a narrow bore which is preferably threaded to securely receive a grease fitting 197 or other fluid coupling. Second segment 192 is broader than the first segment and defines chambers 198, 199 divided by piston 181. Third segment 193 is broader than the second segment to define an inner shoulder 201.

Third segment 193 is preferably threaded adjacent shoulder 201 to secure therein an annular collar 203 adapted to close chamber 199, except for the passage of piston rod 205. Hollow piston rod 205 is threadedly anchored in bore 204 in bottom wall 206 of base 177. Spring 183 is placed in compression between collar 203 and bottom wall 206 so that it biases body 179 out of base 177. A side passage 207 is defined to extend through body 179 and fluidly connect to chamber 199. A grease fitting 210 or other fluid coupling is secured at the end of passage 207 to charge and discharge grease or other fluid from chamber 199. Contained within the hollow bore of the piston rod is an ejector pin 214.

Body 179 further has a head 216 which includes a broad arcuate bearing face 218 (FIG. 17–19) configured in the same way as face 122 of lock 14. Accordingly, bearing face 218 abuts against bearing face 151 of point 12 in the same way as bearing face 122 of lock 14. A notch 220 is preferably formed in head 216 to provide access to grease fittings 197, 210.

In operation, lock 175 is first inserted into hole 103 of adapter 13. Grease or other fluid is fed through passage 207 and into chamber 199 so as to retract head 216 fully into cavity 185. Point 12 is placed onto nose 20 of adapter 13. The fluid is then discharged from chamber 199 via passage 207 to permit spring 183 to push bearing face 218 of head 216 into contact with bearing face 151 of point 12 (FIG. 16). Body 179 is supported solely by spring 183 to hold and pull point 12 onto nose 20. The strength and orientation of the spring and the angle of inclination of the bearing face enables the spring to hold the point on the nose and avoid overloading during use. As an alternative, grease or other fluid may be fed into chamber 198 to hold the body 179 in its extended and locked position.

Lock 175 need not be removed from hole 103 in adapter nose 20 when replacing the point. Nonetheless, to remove lock 175 from hole 103 (i.e., after a point has been removed), grease or another fluid is pumped into chamber 198. Once body 179 reaches its maximum extension, continued charging of chamber 198 causes the ejector pin 214 to be forced through piston rod 205 and against bottom wall 173 of hole 103. The engagement of body 179 against stop 187 will cause base 177 to be forced out of hole 103 by the movement of ejector pin 214.

In another alternative embodiment, lock 225 comprises a base 231, a body 229, a casing 227, and a lock bolt 233 (FIGS. 21–25). As discussed below, base 231 supports body 229 for relative axial motion between the lock and release positions. In this embodiment, a casing 227 with a sealed cavity 235 is provided to movably receive body 229 and prevent soil fines from blocking retraction of the body in effecting release of the point. A key and keyway, as described and illustrated for lock 14, are provided to prevent turning of the body relative to the casing. A central bore 241 extends through body 229 for receipt of base 231. Base 231 includes a threaded shank portion 243 and a head portion 245. Shank portion 243 and bore 241 are each formed with large mating threads 247 (preferably about 1 inch (25 mm) or greater diameter) for axial movement of body 229 relative to base 231.

Figure 21:
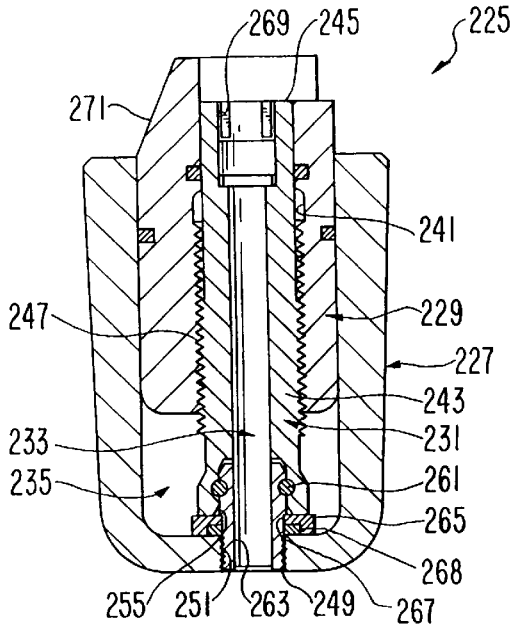
FIG. 21 is a sectional view of a third embodiment of an extensible lock.
Figure 22:
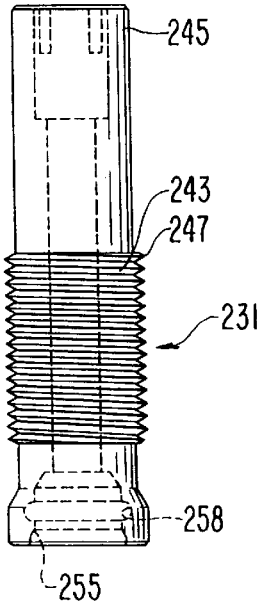
FIG. 22 is a side view of a base for the third embodiment.
Figure 24:
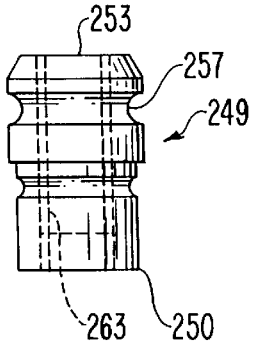
FIG. 24 is a side view of an anchor for the third embodiment of an extensible lock.
Figure 23:
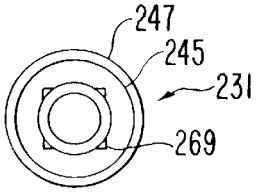
FIG. 23 is a top view of the base for the third embodiment.
Figure 25:
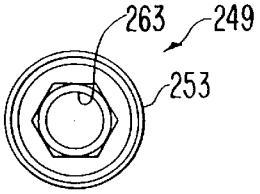
FIG. 25 is a bottom view of the anchor.

At the base of lock 225 is provided an anchor 249 for base 231 and lock bolt 233. Anchor 249 includes a threaded shank portion 250 which is secured into threaded bore 251 in casing 227, and an upstanding head portion 253 which is received into a recess 255 defined in the end of base 231. Mating grooves 257, 258 are provided in head portion 253 and recess 255 for receiving a snap ring 261, which holds the two components 231, 249 together. A threaded bore 263 in anchor 249 threadedly receives lock bolt 233. The bottom end of bore 263 has a square or hex recess (FIG. 25), which permits it to be tightened in thread bore 251. The bottom of base 231 sets on platform 265 which includes a central aperture 267 through which anchor 249 extends and a counter bore 268 for a disc shaped seal (FIG. 21).

In use, lock 225 is placed within hole 103 in the adapter nose. A wrench or the like (not shown) is used to engage and rotate base 231 via flats 269. Turning of the base 231 causes body 229 to retract in cavity 235 so that point 12 can be placed on adapter 13. Once the point is placed on the nose, base 231 is rotated in the other direction as far as it will go to drive bearing face 271 of body 229 outward and against rear face 151 of hole 145. Bearing face 271 has the same construction as bearing face 122 of lock 14 in order to achieve the same pulling and holding functions during installation. Once base 231 is fully rotated, lock bolt 233 is tightened against a lock washer (not shown) so that head 273 in cooperation with base 265 clamps base 231 in a fixed position. Lock bolt 233 has a recess (e.g., a hex recess or screw driver slot) to facilitate its tightening and loosening. This clamping arrangement prevents vibrations and the like from loosening the body during use.

Figure 26:
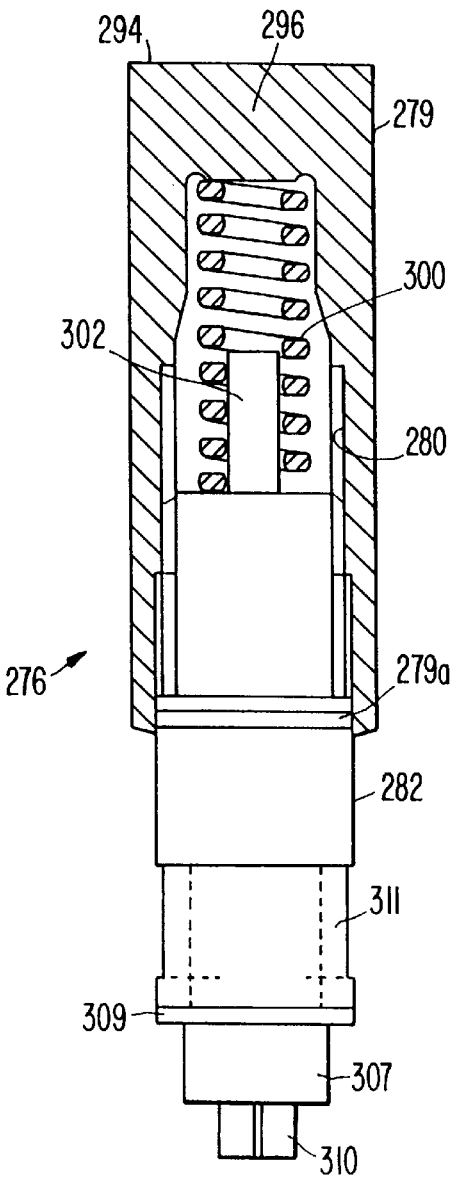
FIG. 26 is a partial sectional view of a fourth embodiment of an extensible lock.
Figure 27:
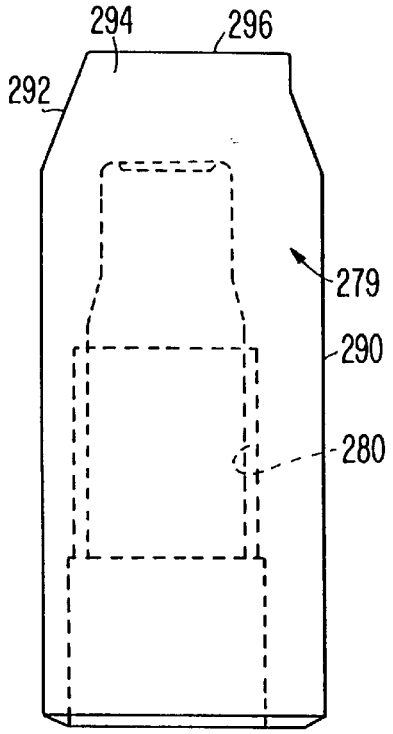
FIG. 27 is a side view of a body of the fourth embodiment.
Figure 28:
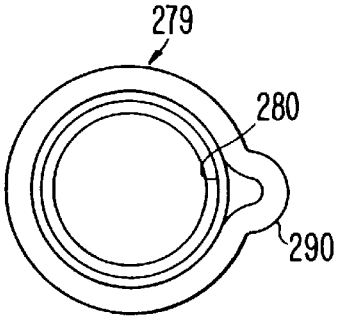
FIG. 28 is a bottom view the body of the fourth embodiment.
Figure 30:
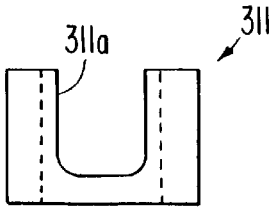
FIG. 30 is a side view of the spacer of the fourth embodiment.
Figure 31:
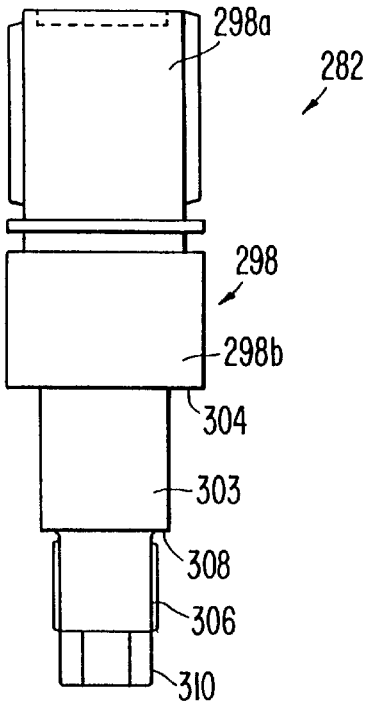
FIG. 31 is a side view of a base of the fourth embodiment.
Figure 32:
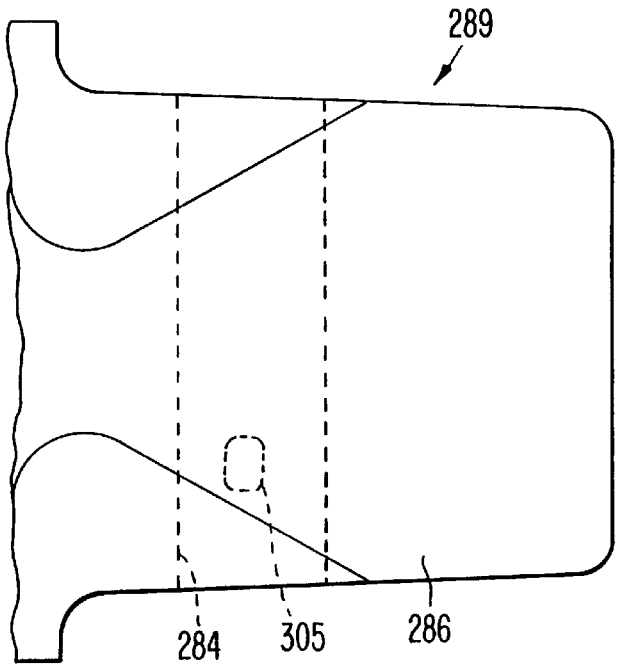
FIG. 32 is a partial top view of an adapter formed to receive a lock in accordance with the present invention.
Figure 33:
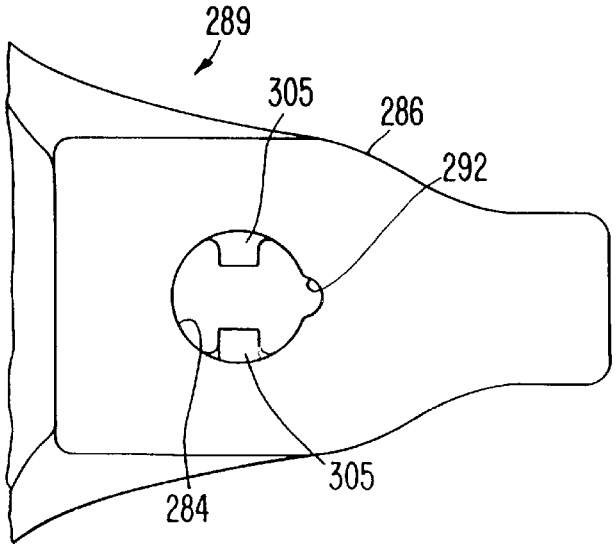
FIG. 33 is a partial side view of the adapter formed to receive a lock in accordance with the present invention.

In another alternative construction, lock 276 includes a generally hollow body 279 with an axial cavity 280 which is threaded along at least part of its length, and a base 282 threadedly received into the cavity of the body (FIGS. 26–31). As opposed to earlier embodiments, lock 276 is fit into a transverse hole 284 which extends entirely through nose 286 of adapter 289 (FIGS. 32–33). Body 279 has an outer key 290 which is matingly received in a keyway 292 formed in hole 284 to prevent rotation of the body (FIGS. 27–28 and 33). While key 290 is preferably an elongate longitudinal bump, the body construction could have a wide variety of shapes or attachments to prevent rotation of the body within hole 284. The body further includes a bearing face 292 on its outer end 294 (FIG. 27) to engage bearing face 151 of point 12 (FIGS. 3 and 4). As noted for face 122 of lock 14, bearing face 292 preferably has a broad, arcuate shape to better accommodate movement of the point during a digging operation. The outer end 294 is closed with an end wall 296 to prevent the ingress of soil fines into the threaded cavity and provide greater strength for holding the point onto the adapter nose.

Base 282 is an axial member which supports the body for axial movement between the lock and release positions. Base 282 includes a main segment 298 provided with a threaded region 298*a* which engages the internal threads of cavity 280, and a generally smooth head region 298*b* (FIGS. 26 and 31). As base 282 is rotated, body 279 extends and retracts between a locked position where body 279 extends into the opening 145 in the mounted wear member, and a release position where body 279 is received entirely into hole 284 in the adapter. A groove is formed to receive a seal 279*a* (e.g., an O-ring) which engages the inner wall of cavity 280 to prevent soil fines from entering the threaded region. A coil spring 300 is preferably positioned in cavity 280 between base 282 and end wall 296 to avoid inadvertent loosening of the body during use. However, other means to resist unwanted rotation between the base and body caused by vibrations and other forces encountered during use of the excavating tooth could also be used. A rod 302 projects outward from segment 298, within coil spring 300, to prevent over rotation of the base in retracting body 279.

A narrowed neck portion 303 extends outward from main segment 298 to form an outwardly facing shoulder 304 (FIG. 31). Neck 303 and shoulder 304 are adapted to cooperate with a pair of ribs 305 formed within the transverse hole 284 of adapter 289 (FIGS. 26 and 31–33). The shoulder 304 abuts the end of the ribs 305, while neck 303 extends between the opposed ribs 305. In this way, the ribs provide a fixed surface against which base 282 can press when body 279 is extended outward by rotation of base 282. Accordingly, the bearing face 292 of body 279 can be pressed against face 151 of the wear member, to pull the wear member (e.g., a point) onto nose 286. While constructions other than the ribs could be used as stops, the ribs are preferred because they provide sufficient strength and minimize obstacles for ejecting the soil fines upon retraction of body 279.

A second threaded portion 306 extends outward from neck 303 to receive a lock nut 307 (FIGS. 26 and 31). Threaded portion 306 is narrower than neck 303 to be received through ribs 305 and form a second shoulder 308. A washer 309, placed against shoulder 308, forms a stop against which lock nut 307 is tightened. Ribs 305 are thus contained between main segment 298 and washer 309 to secure lock 276 within hole 282. Other arrangements, such as an outwardly biased detent (not shown) to support the washer, could alternatively be used to secure the lock within hole 284. The gap between shoulder 304 and washer 309 is slightly longer than the length of ribs 305 so that the ribs are loosely held by lock 276. In this way, washer 309 does not tighten against the ribs and thereby hinder the rotation of base 282.

Figure 29:
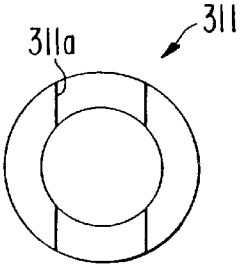
FIG. 29 is a bottom view of a spacer of the fourth embodiment.
Figure 34:
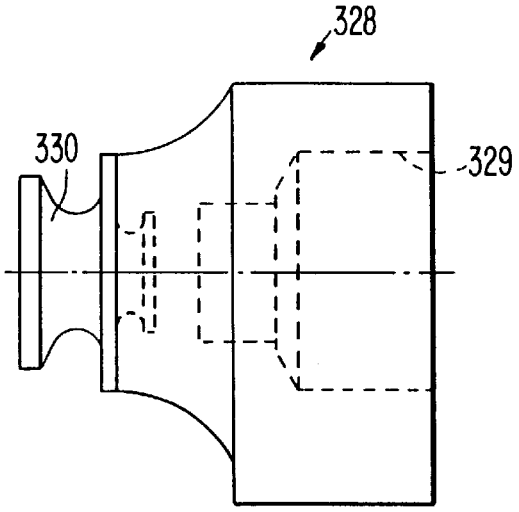
FIG. 34 is a side view of a plug for use in connection with the fourth embodiment of the lock.
Figure 35:
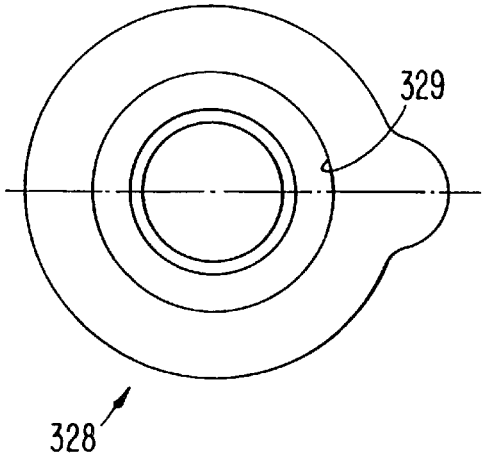
FIG. 35 is a top view of the plug.

Lock 276 preferably includes a spacer 311 between shoulder 304 and washer 309 (FIGS. 26 and 29–30). The spacer includes a pair of slots 311*a* which receive ribs 305 such that the ribs are surrounded on essentially all sides by spacer 311 and neck 303. The exterior of spacer 311 is substantially the same diameter as base 282 so that a smooth path is provided for movement of the soil fines out of hole 284 during retraction of body 279. Spacer 311 is about the same length as ribs 305 so that it is also loosely contained between shoulder 304 and washer 309. A soft rubber (or other elastomeric) plug 328 (FIGS. 34 and 35) with a graduated cavity 329 is preferably pressed into hole 284 over head 310 and nut 307 to hinder or prevent the entrance of soil fines into hole 284. A metal cap 330 or the like is preferably fixed to the plug to enable its removal from hole 284 by prying or pulling.

To accomplish initial lock installation, lock 276 less the washer, spacer and nut is inserted into hole 284 and against ribs 305 before the wear member is placed on nose 286. The spacer 311 and washer 309 then are inserted from the opposite end of hole 284 over the portion 303 and against the face 308 respectively of base 282. The lock nut 307 is turned onto the threads 306 of base 282. Then the wear member is installed. When first assembled, the lock nut is rotated after it tightens against washer 309 so as to rotate the entire base 282. As the body moves outward and presses against bearing face 151, the lock nut is upsettably tightened onto threaded portion 306 to prevent inadvertent loosening of the nut during use. During further operations of lock 276, after the initial tightening of lock nut 307, a hex or other head 310 is provided for rotating the base 282. Replacement of a worn wear member is preferably accomplished by turning base 282 with a ratchet wrench or air impact wrench applied to head 310 to retract and then re-extend body 279. As with the earlier embodiments, there is no need to remove the lock from the hole in the adapter nose to replace the worn wear member.

Figure 36:
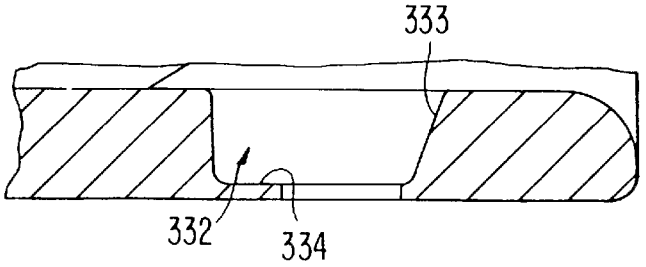
FIG. 36 is a sectional view of a hole formed in a sidewall of a wear member adapted for use with an extendible lock in accordance with the present invention.

With the use of lock 276, a hole must be provided in each side of the wear member. One hole (not shown) is provided to enable the user to access the lock nut 307 and head 310 for rotation. The other hole 332 defines the bearing face 333 adapted to abut the bearing face 292 of the lock (FIG. 36). Hole 332 in the wear member preferably has an outer portion which narrows to a width which is less than the width of body 279 to act as a stop. The portion of the hole outside of bearing face 333 is partially or fully closed to form a wall 334 generally orthogonal to the movement of the body to form the stop; nevertheless, other configurations could of course be used. In this way, the body cannot be inadvertent pushed out of the assembly in the event a worn adapter nose permits rearward movement of wear member to an extent that bearing face 292 is able to drive past bearing face 333. Nevertheless, uniform openings on both sides can be used if desired, or if the wear part is intended to be reversibly mounted.

Figure 38:
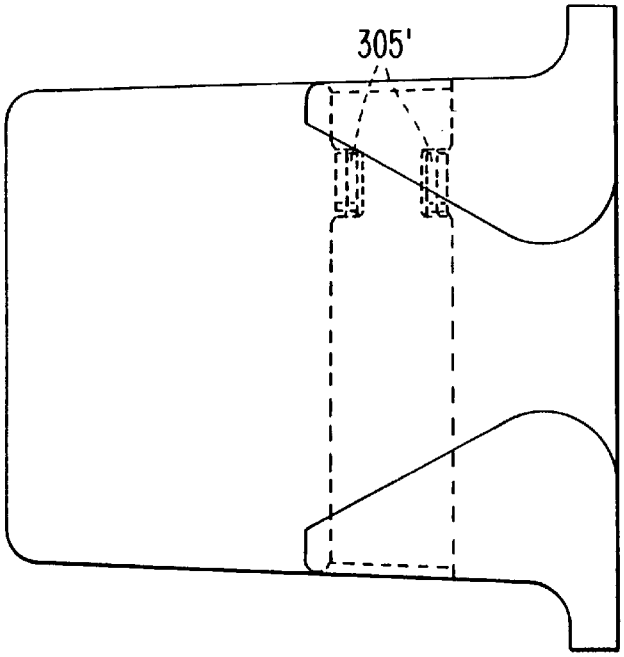
FIG. 38 is a partial top view of an adapter formed to receive the lock of the fifth embodiment.
Figure 37:
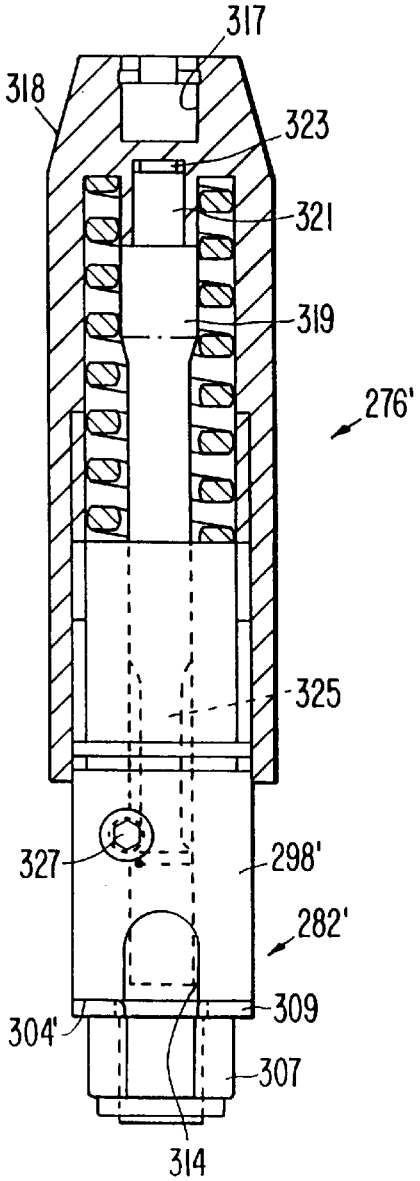
FIG. 37 is a sectional view of a fifth embodiment of an extensible lock.
Figure 39:
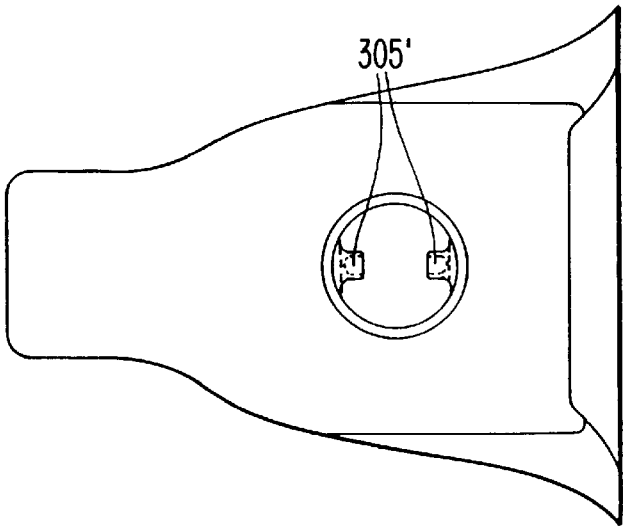
FIG. 39 is a partial side view of the adapter formed to receive the lock of the fifth embodiment.

In an alternative lock 276', the main segment 298' of base member 282' is extended to eliminate the neck and spacer (FIG. 37). In this arrangement, the base member includes grooves 314 to accommodate ribs 305' (FIGS. 37–39). The washer 309 and lock nut 307 are then pressed against the shoulder 304' of the extended main segment. In this embodiment, the ribs prevent rotation of the base. Accordingly, a hex socket 317 or the like is formed in the outer end of the body to rotate the body for extension and retraction of the body. The outer end of the body is provided with a uniform frustal surface 318 to engage the bearing face 151 of the wear member.

A retainer rod 319 is preferably provided within the lock to prevent over extension of the lock (FIG. 37). Rod 319 preferably includes a stud 321 which is threadedly attached to the body. A lock washer 323 is provided to prevent inadvertent release during use. Rod 319 further includes a reduced portion 325 which cooperates with a transverse screw 327 in base 282' to permit rotation and limited axial motion between the rod and the base.

In another alternative embodiment, lock 336 includes a body 337, a base 338, and a casing 339 (FIGS. 40–46). The body 337 is a generally hollow cylindrical member with an axial cavity 341 which is at least partially threaded to receive the base 338. The outer end of body 337 is formed as a head 343, which is preferably solid, to engage and hold the point on the adapter nose. Head 343 is preferably formed with an inclined, arcuate bearing face 344 (like face 122 in lock 14) to engage a complementary bearing face 333 formed in the wear member (FIG. 36). In this embodiment, body 337 is axially moved in cavity 340 of casing 339 (FIG. 40) to hold and release the point. A longitudinal slot 345 formed along a length of the body receives a stop 348 secured in casing 339 to prevent rotation of the body (FIGS. 40–43). A seal 346 is provided in a groove formed near the distal end of body 337 to prevent soil fines from entering the open distal end 347 of the casing and blocking the path of the body's movement.

Figure 40:
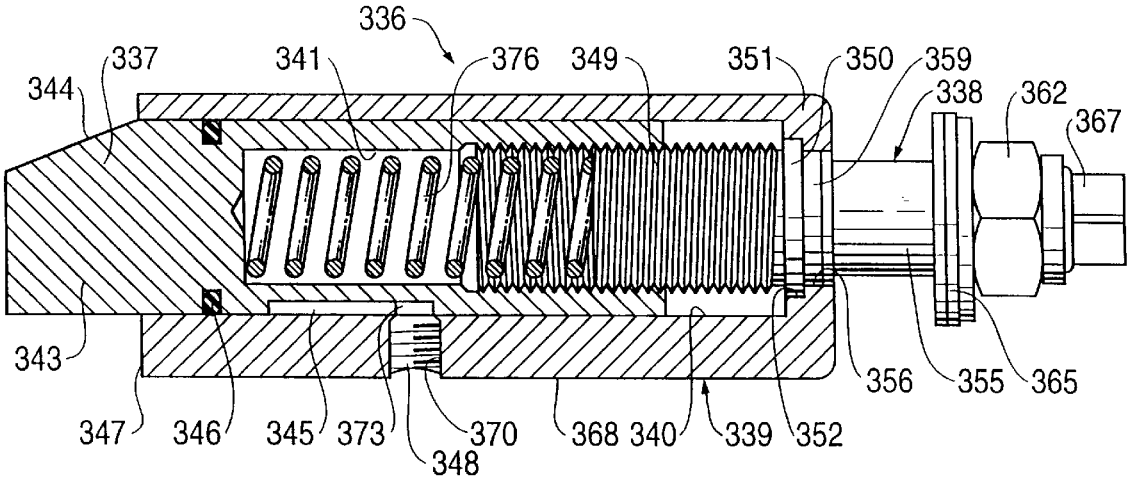
FIG. 40 is a sectional view of a sixth embodiment of an extensible lock.
Figure 41:
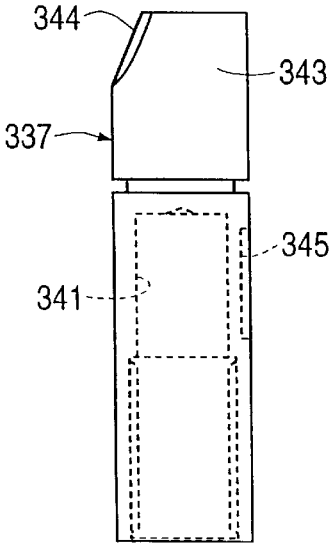
FIG. 41 is a side view of a body of the sixth embodiment.
Figure 42:
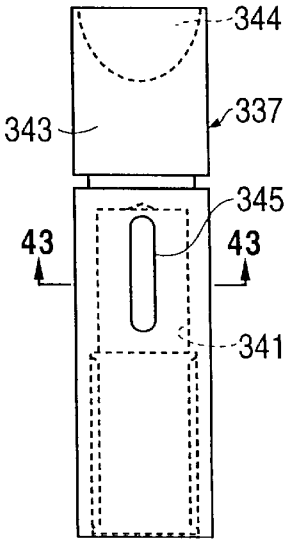
FIG. 42 is a rear view of the body of the sixth embodiment.
Figure 44:
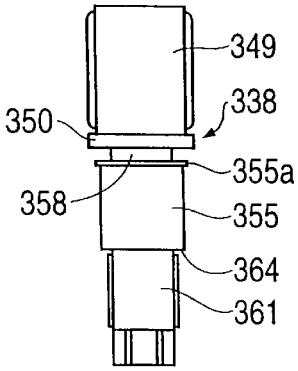
FIG. 44 is a side view a base of the sixth embodiment.
Figure 43:
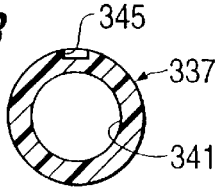
FIG. 43 is a cross sectional view taken along line 43—43 in FIG. 42.
Figure 45:
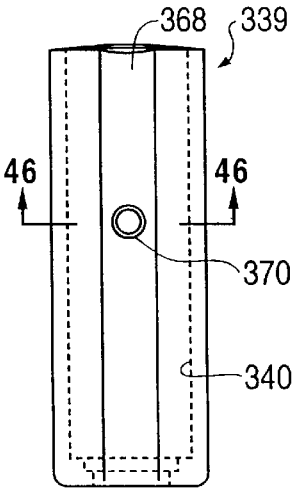
FIG. 45 is a side view of a casing of the sixth embodiment.
Figure 46:
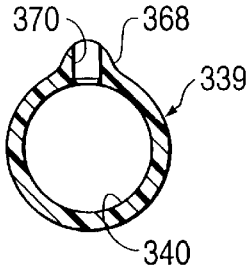
FIG. 46 is a cross sectional view taken along line 46—46 in FIG. 45.

Base 338 is coupled to body 337 to support the axial motion of the body between the lock and release positions. Base 338 is preferably a solid, elongate member formed with graduated segments (FIGS. 40 and 44). The first segment 349 at one end is threaded so as to be threadedly received into a threaded portion of cavity 341 in body 337. Rotation of the base causes body 337 to be axially moved into or out of casing 339. A flange 350 is provided at the proximal end of first segment 349 to abut against the end wall 351 of casing 339 and provide the needed resistance to pull and hold the point onto the adapter nose. Preferably, the flange is received in a counterbore 352 in end wall 351. The second segment 355 is shaped to fit within the ribs 305 formed in the transverse bore in the adapter nose (FIGS. 32 and 33). The second segment 355 (FIGS. 40 and 44) is also sized to fit through bore 356 in end wall 351 in assembling the lock together. The second segment 355 preferably flares at its distal end to define a flange 355*a* opposite flange 350. Flanges 350, 355*a* define a groove about neck portion 358 to receive and retain a seal 359. Seal 359 prevents the entry of soil fines through bore 356 and into casing 339. The third segment 361 at the outer end is threaded to receive a lock nut 362. Third segment 361 has a smaller diameter than second segment 355 to form a shoulder 364. The lock nut tightly holds washers 365 against shoulder 364 such that the lock is attached to the ribs 305 so as to permit rotation of the base 339. As discussed in earlier embodiments, the ribs are held loosely by lock 336. Finally, base 338 includes a head 367 with flats or another shape to receive an impact or other wrench to effect turning of the base.

Casing 339 includes a cavity 341 which movably receives body 337 and prevents soil fines from blocking the retraction of the body. As noted above, the cavity 341 of casing 339 is sealed by seals 346, 359 to prevent the ingress of soil fines into the casing. As a result, the body can be easily retracted to accommodate replacement of a point without needing to displace soil fines which may become imbedded in hole 284 of the adapter nose. Retraction of body 337 is thus achieved irrespective of the type of soil being excavated, the duration of use since the last replacement, or the length of time the tooth sets without use before the point is replaced.

Casing 339 (FIGS. 40, 45 and 46) is also formed with a key 368 in the form of a longitudinal ridge along its length (although it could extend a shorter distance) which is received in a corresponding channel 292 (FIG. 33) in the adapter nose hole 284 to prevent turning of the casing. Of course, other key and keyway arrangements could be used as well as corresponding non-circular mating surfaces. Casing 339 further includes a transverse threaded hole 370 for receiving stop 348. The threaded stop includes a nose 373 which is received into slot 345 formed in body 337.

In this embodiment, lock 336 is placed within hole 284 in adapter nose 286 before the mounting of the point on the nose. As with lock 276, lock 336 is initially inserted into hole 284 without washers 265 and lock nut 262. Once inserted into hole 284, the washers and lock nut are assembled on base 338 to secure the lock to ribs 305. After a point is placed on the nose, the base is rotated by a wrench to move the bearing face 344 of body 337 into contact with bearing face 333 of the point. The base is preferably turned until a predetermined resistance is achieved. As can be appreciated, extension of the body causes the point to be pulled and held onto the nose of the adapter. A coil spring 376 is provided in cavity 341 between body 337 and base 338 to prevent loosening of the body on account of vibrations or other forces encountered during use. When the point needs to be replaced, the base is rotated in the opposite direction to retract the body into casing 339 and out of transverse hole 332 of the point. The point can then be removed and replaced without removing the lock from the hole in the adapter nose.

Figure 47:
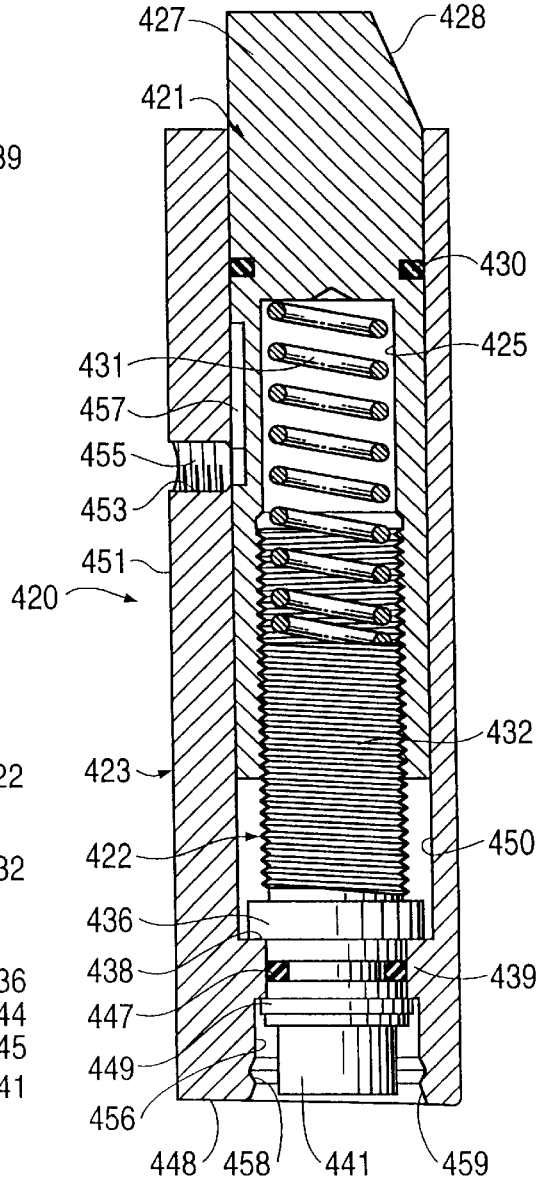
FIG. 47 is a sectional view of a seventh embodiment of an extensible lock.
Figure 48:
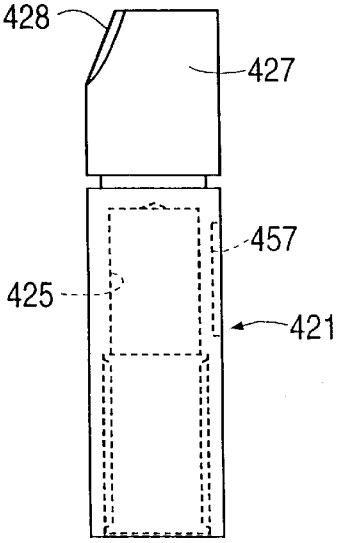
FIG. 48 is a side view of a body of the seventh embodiment.

In the preferred alternative embodiment, lock 420 includes a body 421, a base 422, and a casing 423 (FIGS. 47–51). Body 421, like body 337, includes an open axial cavity 425 with internal threads for receiving the base, a head 427 with an inclined, arcuate bearing face 428, and a seal 430 near its distal end to prevent the ingress of soil fines through the open distal end of casing 423 (FIGS. 47 and 48). A coil spring 431 under compression is provided in cavity 425 between body 421 and base 422 to prevent loosening of the body during use.

Figure 49:
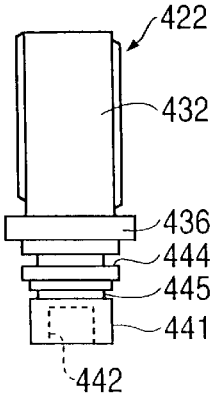
FIG. 49 is a side view of a base of the seventh embodiment.

Base 422 is coupled with body 421 to support the axial motion of the body between lock and release positions. Base 422 includes a threaded distal end 432 for threaded engagement with cavity 425 in body 421 (FIGS. 47 and 49). A flange 436 adjacent threaded end 432 abuts against internal face 438 of rim 439 within casing 423 to provide the needed resistance to pull and hold the point on the adapter nose. A head 441 with a hex socket 442 (or other tool engaging construction) is provided on the outer end of the base to effect turning of the base. A pair of grooves 444, 445 are formed between flange 436 and head 441 to receive a seal 447 and retaining ring 449. Seal 447 (e.g., an O-ring) is placed in groove 444 to prevent the ingress of soil fines into cavity 450 of the casing. Retaining ring 449 is set in groove 445 to hold the base and casing together. The retaining ring is preferably a Waldes Truarc® retaining ring, though other industrial retainers could be used.

Figure 50:
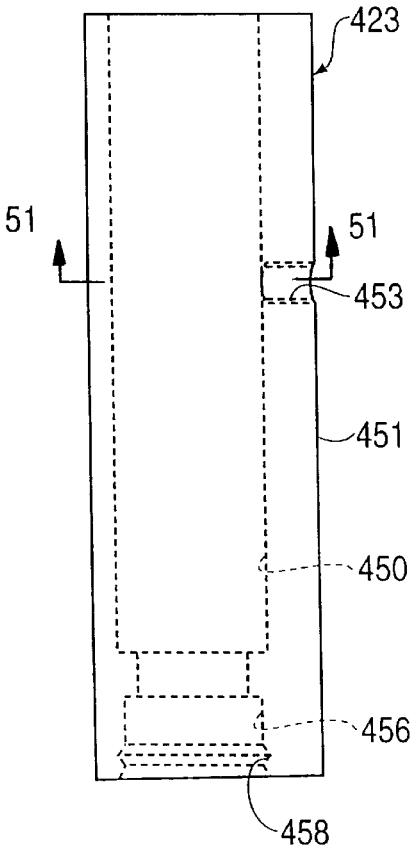
FIG. 50 is a side view of a casing of the seventh embodiment.
Figure 51:
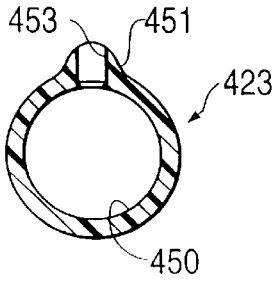
FIG. 51 is a cross sectional view taken along line 51—51 in FIG. 50.

Casing 423, like casing 339, is a generally hollow member for receiving the body 421 and base 422 and preventing the collection of soil fines in the path of body 421 to ensure an easy retraction of the body under all circumstances (FIGS. 47, 50 and 51). As a result, the body can be freely retracted without the need to displace soil fines lodged within hole 452. Casing 423 includes a key 451 in the form of a longitudinal ridge to be received in a channel 451*a* in a transverse hole 452 formed in a nose 453 of adapter 454 (FIGS. 63 and 64) to prevent rotation of the casing. A transverse threaded hole 453 is formed in casing 423 to receive stop 455 which extends into a slot 457 in body 421 to prevent rotation of the body (FIGS. 47, 50 and 51). Casing 423 preferably encompasses the entire length of base 422, As seen in FIG. 47, head 441 is received into a recess 456 at the end of the casing. A circumscribing groove 458 is preferably formed in recess 456 to retain a cap (not shown) to enclose the recess and prevent the ingress of soil fines. A recess 459 is formed in the end of casing 423 to permit the insertion of a tool for removing the cap.

Figure 64:
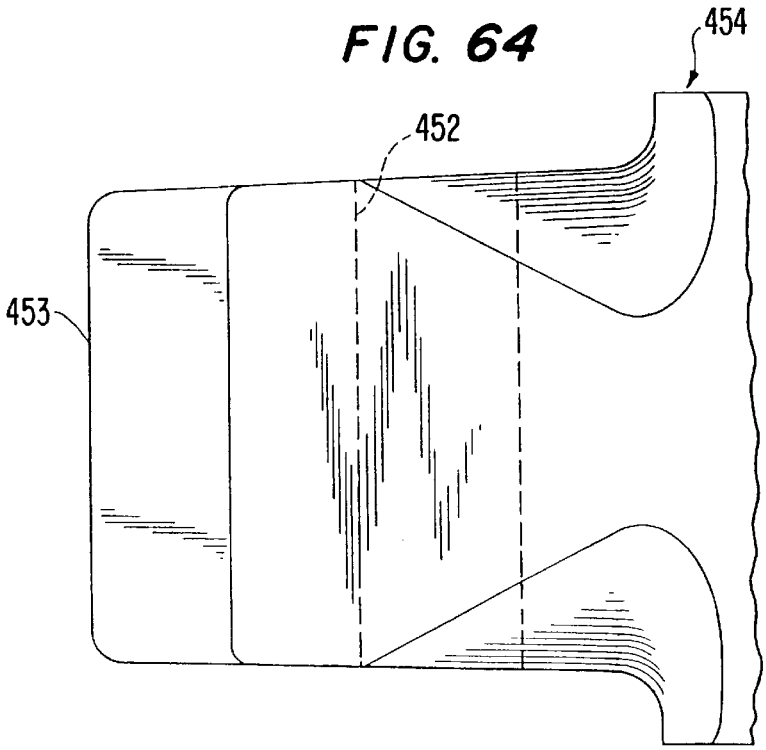
FIG. 64 is a partial top view of the integrally cast adapter.

The hole 452 in the adapter nose 453 extends entirely through nose 453, but does not include any ribs (FIG. 64). Instead, lock 420 is retained in hole 452 by the inner faces of the side walls of the point or other wear member (not shown) received over nose 453; that is, the holes provided in the side walls of the point are smaller than the width of lock 420. Further, as base 422 (FIG. 47) is rotated to extend body 421 outward and enlarge the length of the lock, the end wall 448 of the casing 423 abuts against the inner side wall of the point to provide needed resistance to pull and hold the point in the nose of the adapter. Preferably, the holes in the point are identical to permit mounting of point in either orientation. Moreover, without ribs in the adapter hole, lock 420 can be placed in either hole so as to face in either direction. This versatility eases the assembly of the tooth or other wear member by operators in the field.

Figure 52:
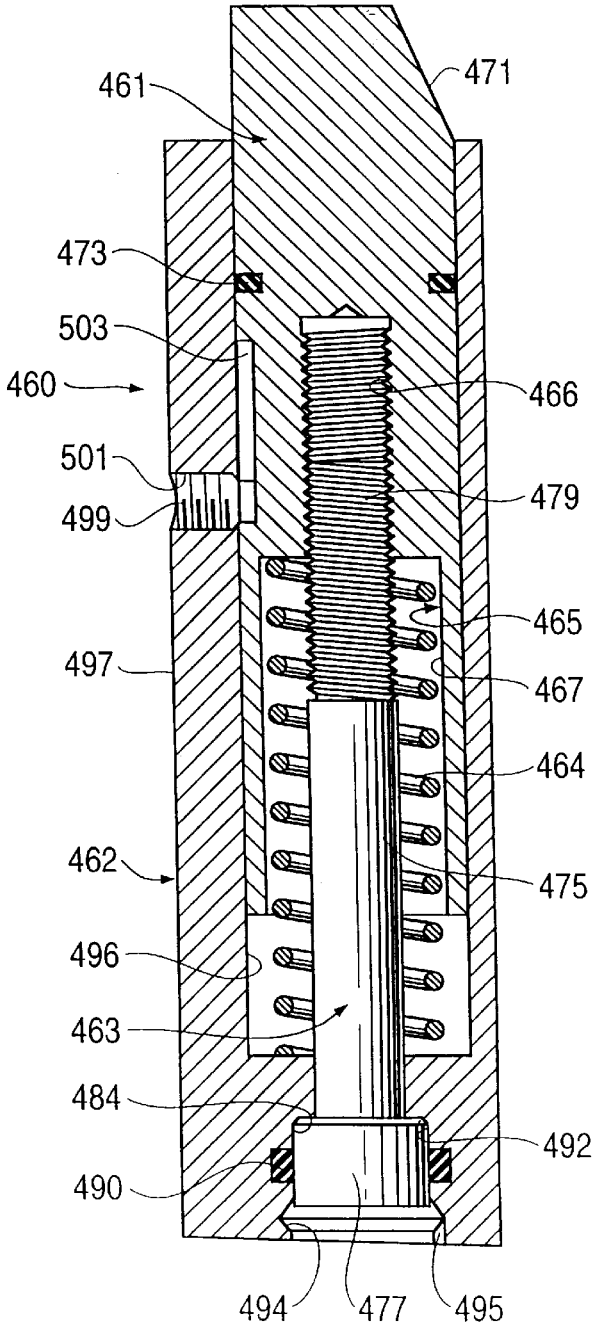
FIG. 52 is a sectional view of an eighth embodiment of an extensible lock.

In another alternative embodiment, lock 460 includes a body 461, a base 462, a retracting screw 463, and a spring 464 (FIGS. 52–56). The body 461 is generally a hollow, cylindrical member which axially moves into and out of base 462. Body 461 has a cavity 465 formed with a narrow, distal segment 466 which is threaded to receive retracting screw 463, and a proximal segment 467 to receive coil spring 464. The distal end of body 461 preferably has an inclined, arcuate bearing face 471 adapted to engage the bearing face 333 (FIG. 36) in one of the holes formed in the point. A seal 473 is received in a groove formed near the distal end of the body to prevent the ingress of soil fines into the base 462 (FIG. 52).

Figure 54:
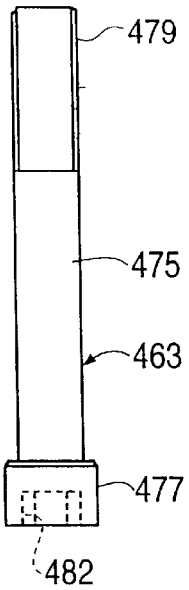
FIG. 54 is a side view of a central screw of the eighth embodiment.
Figure 55:
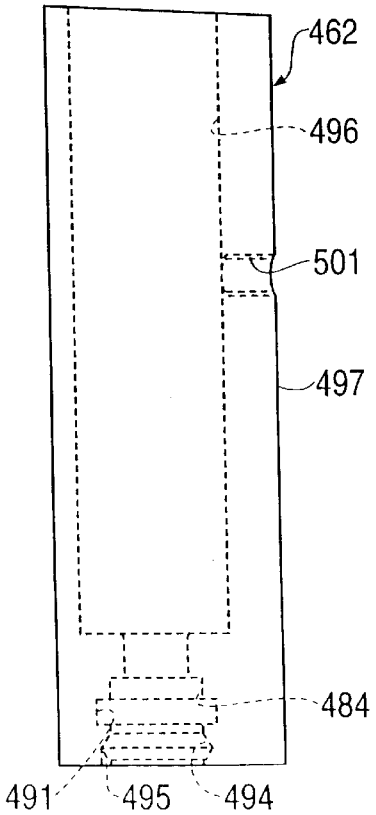
FIG. 55 is a side view of a base of the eighth embodiment.
Figure 56:
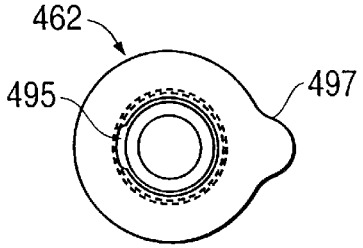
FIG. 56 is an end view of the base of the eighth embodiment.
Figure 57:
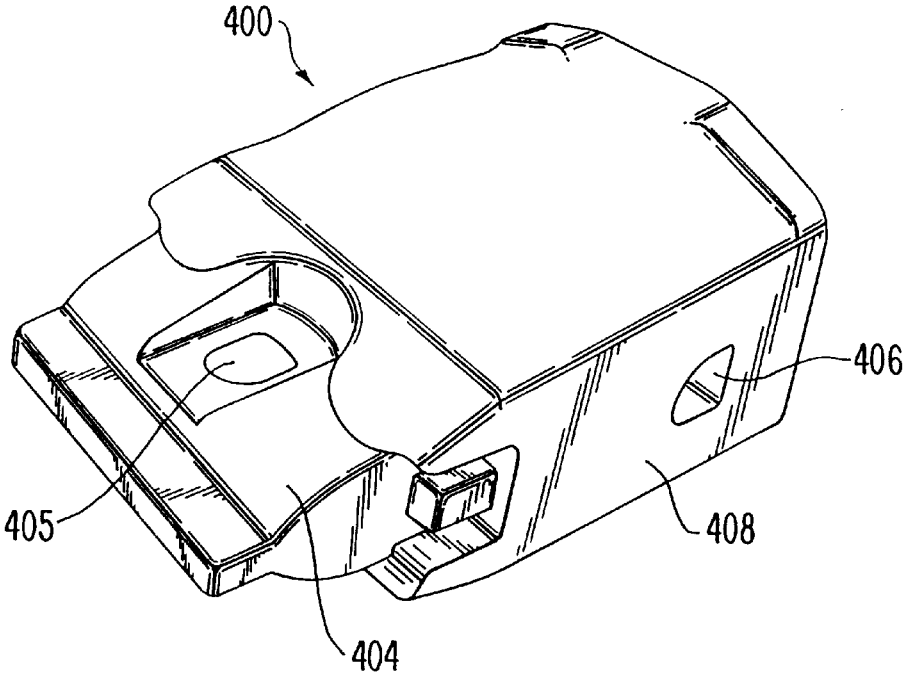
FIG. 57 is a perspective view of an alternative wear member of an excavating tooth which is adapted to be secured by a lock in accordance with the present invention.
Figure 58:
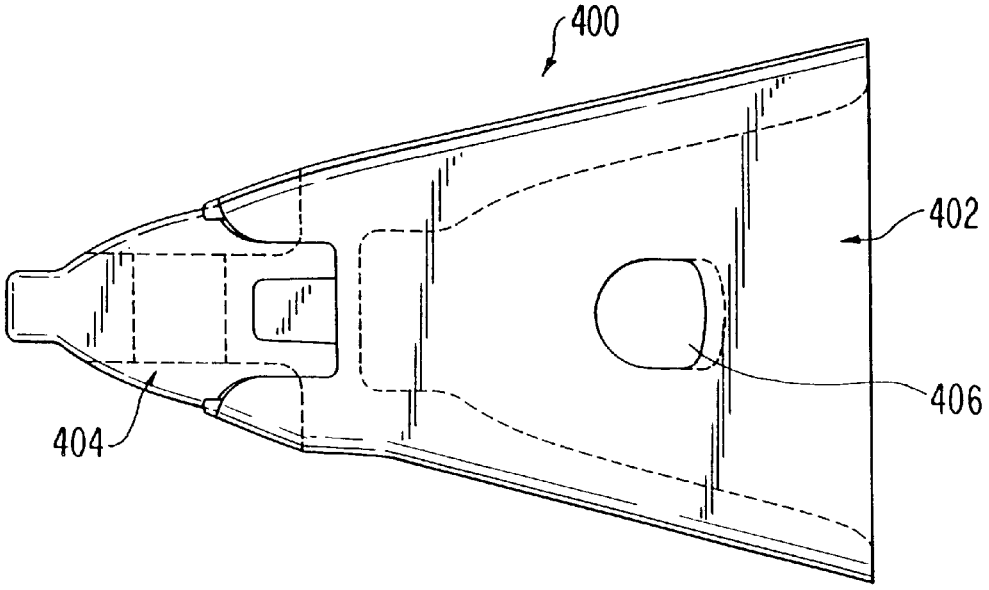
FIG. 58 is a side view of the alternative wear member.
Figure 59:
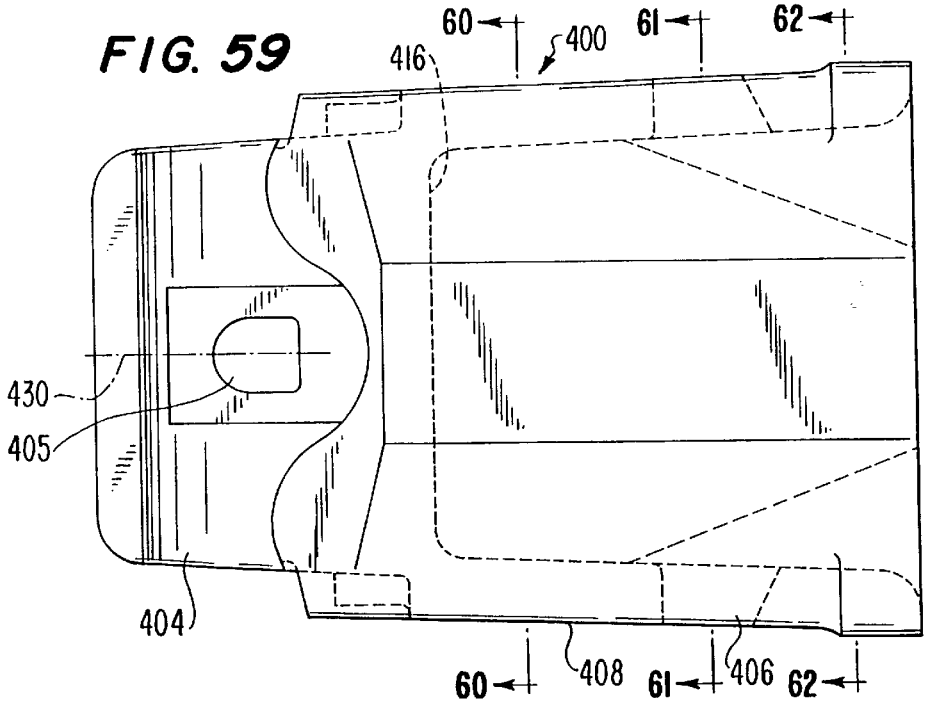
FIG. 59 is a top view of the alternative wear member.
Figure 60:
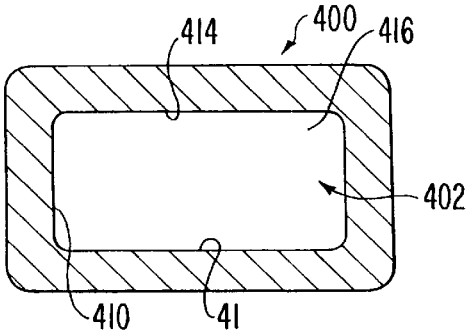
FIG. 60 is a cross-sectional view taken along line 60—60 in FIG. 59.
Figure 61:
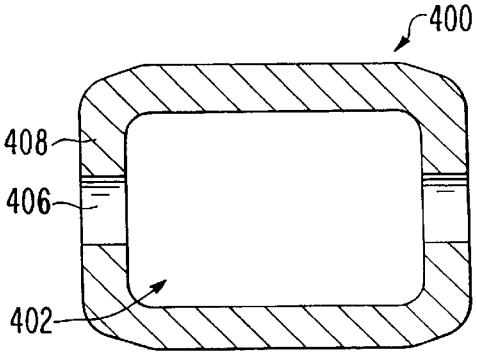
FIG. 61 is a cross-sectional view taken along line 61—61 in FIG. 59.
Figure 62:
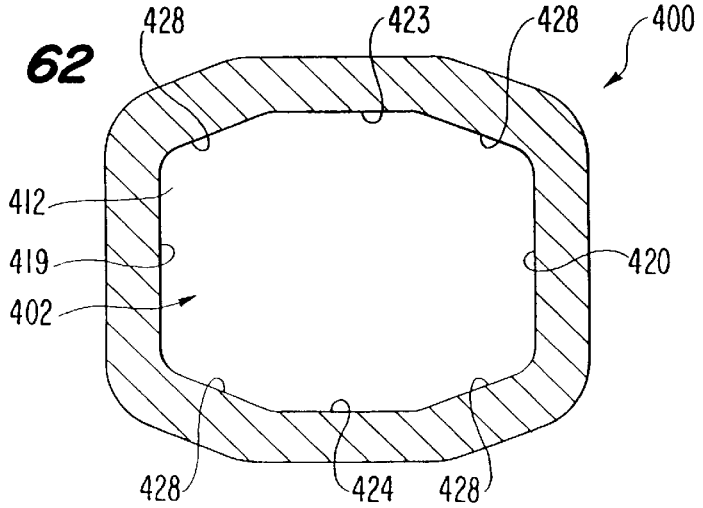
FIG. 62 is a cross-sectional view taken along line 62—62 in FIG. 59.

Retracting screw 463 includes a shank 475 and a head 477 (FIGS. 52 and 54). Preferably, shank 475 is at least threaded on distal end 479, although the entire length of the shank could be threaded. The head 477 has a hex socket 482 or other wrench engaging construction to effect its rotation. The head is received in an opening 484 defined in one end of the base 462 (FIGS. 52, 54 and 55). A seal 490 is received in a groove 491 defined in the circumferential wall 492 of opening 484 to prevent the ingress of soil fines into the base 462 (FIGS. 52 and 55). Wall 492 also includes a groove 494 for receipt of a cap (not shown) to keep the hex socket clean and prevent the unintended rotation of screw 463 during use of the tooth. More specifically, the cap is a generally circular disk member provided with a lateral tab adapted to fit within a recess 495, and a hex protrusion to matingly fit within hex socket 482. The tab abutting the side walls of the recess 495 prevents rotation of the cap, and the receipt of the hex protrusion in the hex socket 482 prevents rotation of the screw 463. In this way, undesired retraction of the screw on account of vibrations or other motions encountered during use can be avoided. The cap is removed by inserting a prying tool into groove 464 about the cap.

Figure 53:
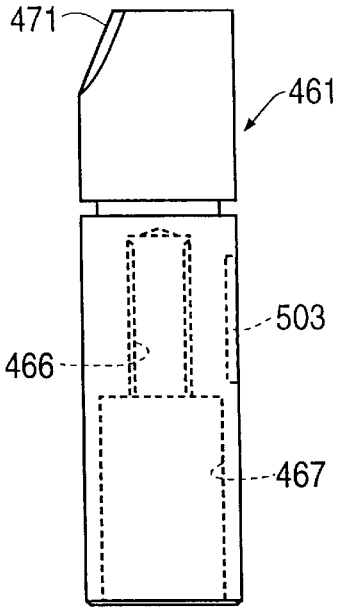
FIG. 53 is a side view of a body of the eighth embodiment.

In this embodiment, base 462 supports the axial motion of the body and provides a clear path for the movement of the body. Specifically, base 462 includes a cavity 496 for movably receiving body 461. The base in cooperation with seals 473, 490 prevents the ingress of soil fines into cavity 496 so as to maintain the path of the body free of obstruction in all circumstances. A key 497, preferably in the form of a longitudinal ridge, is received into channel 451*a* in the hole 452 of the adapter nose 453 (FIGS. 63 and 64) to prevent turning of the base during use. Of course, other key and keyway arrangements could be used. A stop 499 fixed in threaded hole 501 is received into a slot 503 formed in the side of body 461 to prevent rotation of body 461 relative to the base (FIGS. 52, 53 and 55).

In use, lock 460 is placed within a transverse hole 452 in the adapter nose 453 (FIGS. 63 and 64) which matingly receives the exterior shape of the base. As with lock 420, the adapter hole extends entirely through the adapter nose and does not include ribs. Rather, lock 460 (FIG. 52) is retained within the tooth by the side walls of the point or other wear member (not shown). To install a point on the nose, the retracting screw is rotated such that the body 461 is retracted into the base 463. The point includes an opening in each of its two sides. At least one opening includes a complementary bearing face 333 (FIG. 36) to engage bearing face 471 of body 461 (FIG. 52), while the other opening (not shown) permits access to the hex socket 482 in head 477 of base 462 (FIGS. 52 and 54). However, as discussed above with lock 420, the holes in the point are preferably identical to permit mounting of the point in either orientation. Further, the absence of ribs in hole 453 along with identical holes in the point permits the lock 460 to be inserted through either end of the adapter hole and to face in either direction. The openings in the point are, in any event smaller than the width of the casing 463 to prevent removal of the lock with the point on the nose, and to provide the necessary resistance to pull and hold the point on the adapter nose. The screw 463 (FIG. 52) is then turned to extend the body against the bearing face of the point. In this case, the coil spring 464 received between base 462 and body 461 applies the strong axial force to prevent release of the lock under loading. The strength and orientation of the spring 464 and the angle of inclination of bearing face 471 enables the spring to hold the point in place and avoid overloading during use of the tooth. Accordingly, the user continues to rotate screw 463 until the head 477 of the screw begins to move out of opening 484. The head is then turned to effect insertion of the hex protrusion of the cap as the cap is installed into groove 494.

As noted above, the extensible locks of the present invention can also be used to secure wear members other than points. For instance, certain large teeth comprise an adapter (not shown) secured to the digging edge of an excavator, another adapter component 400 (sold by ESCO Corporation as a KWIK TIP® adapter) and a point (not shown). As one other example, adapter 400 (FIGS. 57–62) has a rearwardly opening socket 402 for receipt over the nose of the adapter (not shown) secured to the digging edge and a forwardly projecting nose 404 for mounting the point (not shown). In the illustrated example, nose 404 has a conventional design for mounting the point; although the nose could be formed with another suitable shape. In this example, a hole 405 is provided for receiving a conventional lock pin and an elastomer (not shown) to secure the point to the nose. However, an extensible lock in accordance with the present invention could be used to secure a point to the nose. A hole 406 is preferably provided in both sidewalls 408 of the part for receiving an extensible lock for releasably securing adapter 400 in place.

As with point 12, socket 402 is preferably shaped to include a box-shaped inner portion 410 at its apex and a rearward cavity portion 412 (FIGS. 59–62). Inner portion 410 includes top and bottom bearing faces 414 for resisting vertical loads, and a front bearing face 416 for resisting thrust loads. Cavity portion 412 includes a pair of generally parallel sidewalls 419, 420 a pair of rearwardly diverging top and bottom walls 423, 424, and four bearing faces 428 in each corner of the socket. Bearing faces 428 are formed in the same way as bearing faces 42 described above. Bearing faces 428 extend substantially parallel to the longitudinal axis 430 of the tooth to form a stabilized tooth construction. Moreover, bearing faces 428 are positioned farther from axis 430 to form a tier construction with bearing faces 414.

The above discussion concerns the preferred embodiments of the present invention. Various other embodiments as well as many changes and alterations may be made without departing from the spirit and broader aspects of the invention as claimed.

I claim:

1. A lock for securing a wear member to a support structure of an excavator, the lock comprising a body, a base coupled to said body to form an assembly adapted for insertion into a hole in the support structure, and means for selectively adjusting the relative axial positions of said body and said base to vary the length of the lock between an extended position for securing the wear member to the support structure and a retracted position for releasing the wear member from the support structure, said body having a bearing face for engaging the wear member in said extended position.

2. A lock in accordance with claim 1 in which one of said base and said body includes an end with an opening that movably receives therein the other of said base and said body.

3. A lock in accordance with claim 2 in which said adjusting means includes a threaded connection between said base and said body.

4. A lock in accordance with claim 3 which further includes a spring which applies an outward force between said base and said body to prevent inadvertent loosening of said threaded connection during use.

5. A lock in accordance with claim 2 in which said opening is formed in said body.

6. A lock in accordance with claim 2 in which said opening is formed in said base.

7. A lock in accordance with claim 2 in which said opening is sealed to prevent the ingress of soil fines.

8. A lock in accordance with claim 2 further including a casing engaging said body and said base to define a cavity at least about said end with said opening, said cavity being sealed to prevent the ingress of soil fines in said cavity.

9. A lock in accordance with claim 8 in which said casing includes means for preventing relative rotation of said body.

10. A lock in accordance with claim 9 in which said casing includes means for preventing rotation of said casing in the hole of the support structure.

11. A lock in accordance with claim 8 in which said casing includes means for preventing rotation of said casing in the hole of the support structure.

12. A lock in accordance with claim 2 in which said adjusting means includes a spring which applies an outward force to extend said body relative to said base and applies a holding force which prevents removal of the wear member from the support structure.

13. A lock in accordance with claim 12 in which said opening is sealed to prevent the ingress of soil fines.

14. A lock in accordance with claim 12 in which said adjusting means further includes a screw for retracting the body relative to said base.

15. A lock in accordance with claim 12 in which said adjusting means further includes a fluid chamber for receiving a pressurized fluid to retract the body relative to said base.

16. A lock in accordance with claim 1 in which said adjusting means includes at least one fluid chamber which is selectively filled with a pressurized fluid to vary the length of the lock.

17. A lock in accordance with claim 1 further including a casing engaging said body and said base to define a cavity, said cavity being sealed to prevent the ingress of soil fines in said cavity and thereby provide free retraction of said base and said body without obstruction from such soil fines.

18. A lock in accordance with claim 1 which includes means for preventing rotation between said base and said body.

19. A lock in accordance with claim 18 in which said rotation preventing means includes a key fixed to one of said base and said body and a keyway receiving said key fixed to the other of said base and said body.

20. A lock in accordance with claim 18 in which said rotation preventing means includes each of said base and said body being provided with non-circular portions that are matingly engaged.

21. A lock in accordance with claim 1 in which said base includes means for preventing rotation thereof within the hole in the support structure.

22. A lock in accordance with claim 1 in which said body includes means for preventing rotation thereof within the hole in the support structure.

23. A lock in accordance with claim 1 in which said lock includes a pair of opposed faces adapted to axially encompass at least one protrusion in the hole of the support structure to secure the lock in the hole.

24. A lock in accordance with claim 23 in which one of said faces is supported by a nut threadedly attached to said body.

25. A lock in accordance with claim 1 in which said bearing face is inclined to the longitudinal axis of the lock.

26. A lock in accordance with claim 25 in which said bearing face has a broad convex shape.

27. A lock for securing a wear member on a support structure of an excavator, the lock comprising a base and a body which are threadedly coupled together for relative motion in an axial direction to vary the length of the lock between an extended position that secures the wear member to the support structure and a retracted position that permits removal of the wear member from the support structure, said body including a bearing face for engaging the wear member in said extended position.

28. A lock in accordance with claim 27 which further includes a spring that applies an outward force between said base and said body to prevent inadvertent loosening of said threaded coupling during use.

29. A lock in accordance with claim 27 further including a casing engaging said body and said base to define a cavity, said cavity being sealed to prevent the ingress of soil fines in said cavity and thereby provide retraction of said base and said body without obstruction from such soil fines.

30. A lock in accordance with claim 29 in which said casing includes means for preventing relative rotation of said body.

31. A lock in accordance with claim 30 in which said casing includes means for preventing rotation of said casing in the hole of the support structure.

32. A lock in accordance with claim 27 in which said bearing face is inclined to the longitudinal axis of the lock.

33. An extensible lock in accordance with claim 32 in which said bearing face has a broad convex shape.

34. A lock for securing a wear member on a support structure of an excavator, the lock comprising a body, a base, a spring applying an outward biasing force between said body and said base to hold the lock in an extended position and secure the wear member to the support structure, and a retractor for shortening the length of the lock to release the wear member from the support structure.

35. A lock in accordance with claim 34 in which said base and said body are sealingly engaged to prevent the ingress of soil fines.

36. A lock in accordance with claim 34 in which said retractor includes a screw.

37. A lock in accordance with claim 34 in which said retractor includes a fluid chamber which receives fluid under pressure.

38. A lock in accordance with claim 34 in which said base and said body are coupled together to prevent their relative rotation.

39. A lock in accordance with claim 38 in which one of said base and said body includes means for preventing rotation thereof within the hole of the support structure.

40. A lock in accordance with claim 34 in which said bearing face is inclined to the longitudinal axis of the lock.

41. A lock in accordance with claim 40 in which said bearing face has a broad convex shape.

42. A method of securing a wear member onto a support structure of an excavator, the method comprising adjusting an extensible lock to a retracted position independently of the wear member, placing the lock into a hole in the support structure, placing a wear member onto the support structure, adjusting the lock in the hole to an extended position to engage and hold the wear member on the support structure.

43. A method in accordance with claim 42 in which said adjusting of the lock to an extended position pulls the wear member onto the support structure.

44. A method in accordance with claim 43 in which said lock applies a biasing force which continually pulls the wear member onto the support structure as wearing occurs between the support structure and the wear member.

45. A method in accordance with claim 42 wherein the support structure is an adapter nose.

46. A method of replacing a wear member mounted on a support structure of an excavator, the method comprising retracting an extensible lock received within a hole in the support structure so as to disengage the lock from the wear member, removing the wear member after the lock is retracted, placing a new wear member on the support structure, extending the lock to engage and hold the new wear member on the support structure.

47. A method in accordance with claim 46 in which said lock remains within the hole of the support structure throughout the entire procedure of replacing the wear member.

48. A method in accordance with claim 46 wherein the support structure is an adapter nose.

* * * * *